US009920602B2

(12) United States Patent
Wang

(10) Patent No.: US 9,920,602 B2
(45) Date of Patent: Mar. 20, 2018

(54) SWING CHAMBER PUMP (SCP)

(71) Applicant: WGM Technologies Inc., Calgary (CA)

(72) Inventor: Jianshe (James) Wang, De Winton (CA)

(73) Assignee: WGM TECHNOLOGIES INC., Calgary (CA)

( * ) Notice: Subject to any disclaimer, the term of this patent is extended or adjusted under 35 U.S.C. 154(b) by 527 days.

(21) Appl. No.: 14/418,779

(22) PCT Filed: Aug. 9, 2013

(86) PCT No.: PCT/CA2013/050616
§ 371 (c)(1),
(2) Date: Jan. 30, 2015

(87) PCT Pub. No.: WO2014/022940
PCT Pub. Date: Feb. 13, 2014

(65) Prior Publication Data

US 2015/0198017 A1 Jul. 16, 2015

Related U.S. Application Data

(60) Provisional application No. 61/681,321, filed on Aug. 9, 2012.

(51) Int. Cl.
*E21B 43/12* (2006.01)

(52) U.S. Cl.
CPC ..... *E21B 43/122* (2013.01); *E21B 43/129* (2013.01); *Y10T 137/85986* (2015.04); *Y10T 137/86027* (2015.04)

(58) Field of Classification Search
CPC .... E21B 43/122; E21B 43/129; E21B 43/124; E21B 43/12; F17D 5/00; Y10T 137/86027; Y10T 137/85986
See application file for complete search history.

(56) References Cited

U.S. PATENT DOCUMENTS 5,806,598 A * 9/1998 Amani ..... E21B 43/121 137/155
6,021,849 A 2/2000 Averhoff et al.
6,889,765 B1 * 5/2005 Traylor ..... E21B 43/128 166/105.5
6,973,973 B2 * 12/2005 Howard ..... E21B 43/129 166/105
7,114,564 B2 10/2006 Parrott et al.
(Continued)

FOREIGN PATENT DOCUMENTS

GB 2437306 A 10/2007

*Primary Examiner* — Michael R Wills, III
(74) *Attorney, Agent, or Firm* — Parlee McLaws LLP (CGY); Sean Goodwin

(57) ABSTRACT

A swing chamber pump can be situated within a horizontal wellbore for pumping wellbore fluids to surface using a power gas. The pump has two fluidly independent and separate pump chambers, each having a self-orienting gas valve and a self-orienting fluid outlet. A switch alternately directs the power gas into a chamber for conveying stored fluid therein to a production string, while the other chamber passively fills with wellbore fluids. A latency device converts a continuous motion into a sudden snap actuation of the switch and controls a period of delay between the actuation of the switch.

40 Claims, 17 Drawing Sheets

(56) References Cited

U.S. PATENT DOCUMENTS

| | | | | |
|---|---|---|---|---|
| 7,270,178 | B2 | 9/2007 | Selph | |
| 7,469,748 | B2 * | 12/2008 | Ocalan | E21B 43/128 166/105 |
| 7,789,131 | B2 * | 9/2010 | Gaudette | E21B 43/129 166/105 |
| 2002/0040785 | A1 * | 4/2002 | Amani | E21B 34/066 166/373 |

* cited by examiner

SWING CHAMBER PUMP (SCP)

CROSS-RELATED APPLICATIONS

This application claims the benefits under 35 U.S.C 119(e) of the US Provisional Application Ser. No. 61/681,321, filed Aug. 9, 2012, which is incorporated fully herein by reference.

FIELD

Generally, embodiments of the invention disclosed herein are related to an artificial lifting pump system for a producer of hydrocarbons or other wellbore fluids from a subsurface well, and more particularly, a self-orienting downhole pump for producing fluids such as oil and water from a horizontal or directional well and steam assisted gravity drainage production well.

BACKGROUND

Recently, horizontal wells are preferred over vertical wells due to their larger reserve exposure and higher production rate, which together lead to better economic reward and possible higher recovery of the natural resources. In some cases, heavy oil is effectively produced through injection of a hot fluid, such as steam, to reduce viscosity of the heavy oil and to help drive the heavy oil to a nearby production well.

A proven and practical technology for in-situ operations to produce the larger reserves of heavy oil, such as Canadian bitumen from oilsands, is steam assisted gravity drainage (SAGD). Steam is injected downhole to reduce the viscosity and mobilize heavy oil for recovery at a production well. Downhole pumps, that operate at steam temperature, at large flow rates and at low bottom hole pressures, pump the heavy oil through the production well to the surface. Typical performance characteristics of a suitable SAGD pump can include: fluid lifting rates greater than 1200 $m^3$/d, operating temperatures greater than 250° C., capability of landing at true 90 degrees horizontal sections, a high tolerance of well bore trajectory for running into hole and operation, controllable, stable and low downhole pressure for less back pressure to reservoir, less reservoir sand interruption, a high tolerance of vapor content especially when hot fluid changes phase, a long service life and reasonable installation costs.

To date, production capacity of about 1000 $m^3$/d from a hot SAGD well has been constrained by the capacity of downhole pumps, despite higher maximum reservoir delivery capability.

Further, producing heated heavy oil or bitumen from downhole has been very challenging. The industry in general has not been satisfied with the available hot fluid downhole pumps, in particular for large rate SAGD wells.

Accordingly, attempts to meet the horizontal well and SAGD production have been mainly limited to modification of existing downhole pumps, such as electrical submersible pump (ESP), namely modified for higher temperature application. Other pumps which have been tried include metal on metal progressive cavity pumps (PCP).

Some producers are still using large sucker rod beam pumps, with the increased risks including jeopardizing the productivity and steam chamber growth in exchange for longer pump run life and lower cost when compared to the more expensive high temperature ESP. However, sucker rod pumps which use surface drive reciprocating pumps and PCP's are often challenged by mechanical stress fatigue and other mechanical issues when used in horizontal wells, particularly in changes in well direction.

Other attempts and trials include the use of gear pumps, twin screw pumps and hydraulic gas pumps which are still under development.

U.S. Pat. No. 6,973,973 to Weatherford discloses a hydraulic gas pump (HGP) which utilizes natural gas as a power gas drive for pushing liquid from a chamber landed in horizontal well. After the gas drives the accumulated fluid uphole, the chamber is cycled for fluid charging. For the HGP to function properly, the HGP must land in a particular orientation once it reaches depth. Incorrect orientation of the HGP renders the pump inoperable.

In long horizontal wells, the orientation of the pump chamber is random due to the unpredictable and unavoidable rotation and twisting of the production tubing. As a consequence, there is no assurance that the HGP will function correctly when it is landed at its desired location downhole. As far as Applicant is aware, the HGP pump has so far not been practically used for horizontal producers.

SUMMARY

Herein, a swing chamber pump is provided for horizontal fluid producing wellbores. The pump provides high lifting rates, works at high temperatures, low intake pressures, avoids pump internal flashing, and minimizes or eliminates downhole flow pressure fluctuations.

Embodiments disclosed herein describe a swing chamber pump for use advantageously in horizontal wells. The pump alternately fills one of two chambers with fluids from the wellbore while simultaneously conveying wellbore fluids in the other of the two chambers to a bore of a production string. The fluids are typically oil and water and can include emulsions and particular matter. Each of the two chambers is fluidly connected to the wellbore for receiving wellbore fluids therefrom, and each of the two chambers is fluidly connected to the production string by a self-orienting fluid outlet. The pump further comprises a switch for switching between the two chambers. A pilot assembly can aid in controlling the switch.

In an embodiment, the switch employs a linear mechanism, and in another embodiment, the switch employs a rotary mechanism.

In a broad aspect, a swing chamber pump is provided in a wellbore for lifting wellbore fluids through a production string to surface using a power gas directed from surface. The pump has a first and second pump chamber, each pump chamber having a fluid inlet for receiving the wellbore fluids therethrough from the wellbore, a self-orienting fluid outlet for maintaining fluid communication from a lower portion of the pump chamber to the production string, and a self-orienting gas valve for maintaining fluid communication with an upper headspace portion of the pump chamber and alternately directing the power gas into the upper headspace portion and expelling the power gas therefrom.

In an embodiment, when the power gas is directed into the upper headspace portion of the first pump chamber, the wellbore fluids from the lower portion are conveyed to the production string, and in the second pump chamber the power gas is expelled therefrom while wellbore fluids are received therein. When the power gas is directed into the upper headspace portion of the second pump chamber, the stored wellbore fluids from the lower portion are conveyed into the production string, and in the first pump chamber the power gas is expelled therefrom while wellbore fluids are received therein.

In another broad aspect, a linear switch is driven by a pilot gas provided from surface. The linear switch has a linear valve having a valve core operable between a first and second position, an actuator operable between a first actuation position and a second actuation position, and a latency device between the actuator and a valve core wherein the latency device provides a period of delay or dwell between reciprocation of the valve core between the valve core's first and second positions.

In another broad aspect, a rotary switch is driven by a fluid level in the pump chamber. The rotary switch has a float, a drive assembly, and a rotary valve having an oscillating valve core, the drive assembly converting continuous up and down movement of the float into a rotary oscillation of the valve core between first and second positions. The drive assembly further has a latency device for causing a period of delay or dwell between oscillation of the valve core between the first and second positions.

In another broad aspect, a mechanical latency device for a switch core, such as that used for the swing chamber pump above, has an actuator having a first and second drive stops; an intermediate driven member having a driven interface for alternate driving engagement with the first and second drive stops, the intermediate driven member having first and second switch stops; and a switch core having a switch interface for alternate driving engagement with the first and second switch stops. A difference between the spacing of the drive stops and the switch stops provides the dwell or latency.

In an embodiment, the actuation of the actuator from a first position to a second position engages the first stop with the driven interface of the intermediate driven member, progressively loading an over-center snap device during a latency period until the first switch stop is aligned with the switch interface. This causes the snap device to over-center for unloading the snap device and driving the intermediate driven member, switch interface and switch core to the second position.

Further actuation of the actuator from the second position to the first position engages the second stop with the driven interface of the intermediate driven member, loading the snap device during a latency period until the second switch stop is aligned with the switch interface. Similarly, this causes the snap device to over-center for unloading the snap device and driving the intermediate driven member, switch interface and switch core to the first position.

BRIEF DESCRIPTION OF THE DRAWINGS

FIG. 14B is an axial schematic drawing of the drive assembly of FIG. 14A, illustrating a core stop engaging the snap bar;

FIG. 14C is an axial schematic drawing of the drive assembly of FIG. 14A, illustrating the snap plate overcoming a resistive force of the snap spring at about a midpoint of travel from its first position to its second position;

FIG. 14D is an axial schematic drawing of the drive assembly of FIG. 14A, illustrating the snap plate in its second position;

FIG. 14E is an axial schematic drawing of the drive assembly of FIG. 14A, illustrating a core stop engaging the snap bar when travelling from its second position to its first position; and FIG. 14F is an axial schematic drawing of the drive assembly of FIG. 14A, illustrating the snap plate overcoming the resistive force of the snap spring at about a midpoint of travel from its second position to its first position.

DETAILED DESCRIPTION

Embodiments of a swing chamber pump (SCP) can be situated or positioned within a wellbore for lifting wellbore fluids through a production string to surface using a gas pushing or lift mechanism. The swing chamber pump comprises two fluidly separate pump chambers, each pump chamber passively filling with and temporarily storing wellbore fluids therein. A switch alternately directs a power gas into one of the two pump chambers for urging and conveying the stored wellbore fluids into the production string while the other fills. In an embodiment, the swing chamber pump self-orients to ensure proper functioning.

Swing Chambers

Figure 1:
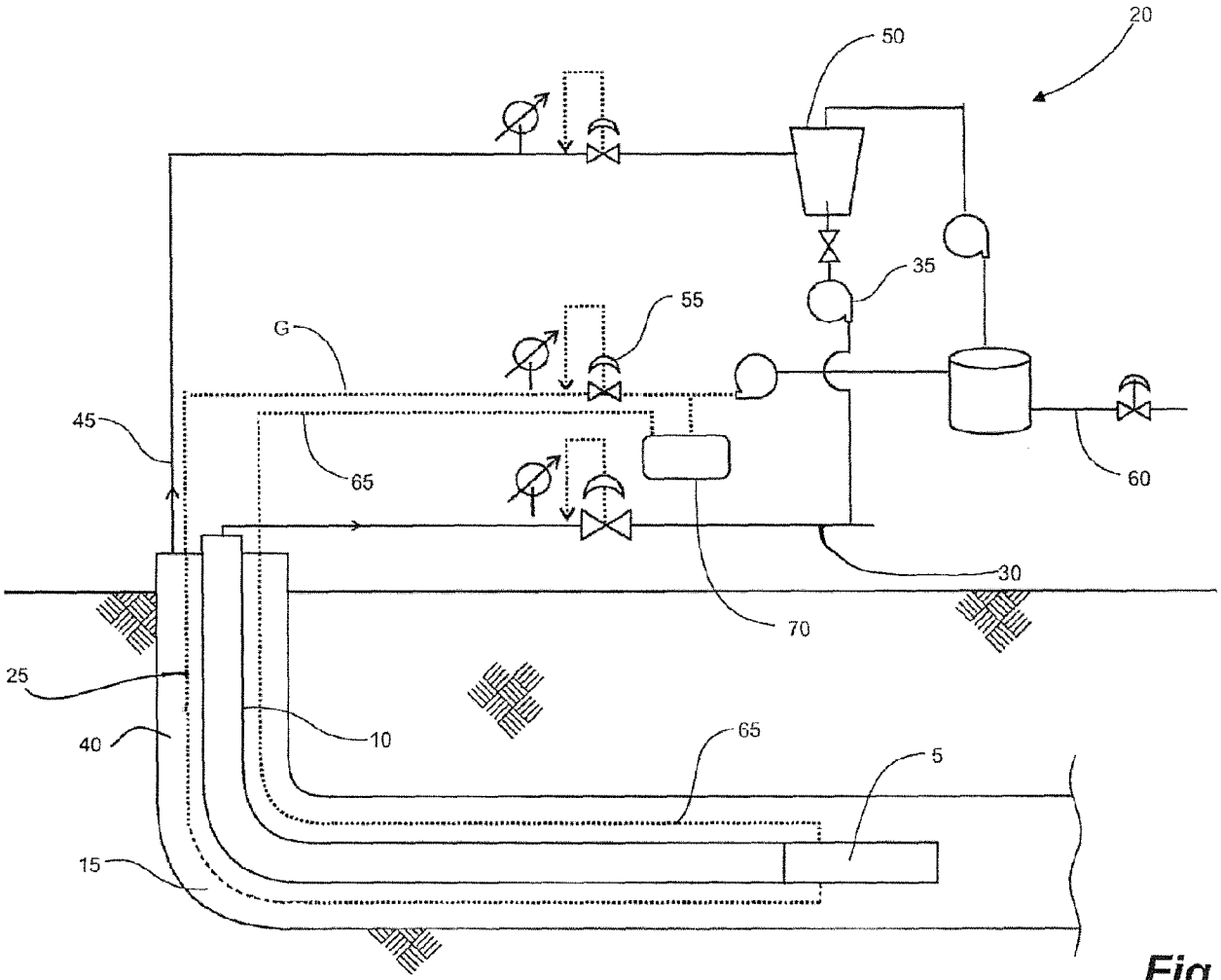
FIG. 1 is a schematic representation of a system operating an embodiment of a swing chamber pump in a wellbore.

With reference to FIG. 1, an embodiment of the swing chamber pump 5 is positioned at a downhole end of a production string 10 located within a wellbore 15. The production string 10 is fluidly connected to a surface system 20. A pressurized source of power gas G is connected to the pump 5 such as through power gas line 25. The produced wellbore fluids can be pumped from the wellbore 15, through production string 10 and into production flow line 30.

In an embodiment, the spent power gas used to lift or pump the wellbore fluids into the production string 10 can be returned to the surface through an annulus 40 between the production string 10 and the wellbore 15. Spent power gas, expelled or exhausted from the pump 5, returns up the annulus 40 and can be recycled to the pump 5 via a return gas line 45. Wellbore gas, also called casing gas, and other liquids can be carried in the return gas line 45 and therefore a liquid remover 50 can be installed to remove any liquids from the returning power gas for providing a dry power gas, which can be recycled and reused as the power gas. Removed liquids can be pumped by a surface pump 35 into the production flow line 30.

In an embodiment, pressure in the power gas line 25 is monitored by a pressure control device 55, and additional power gas can be injected into the power gas line 25 as necessary from a gas make up line 60.

In an embodiment, a pilot gas can be used to actuate a downhole switch for directing the power gas into the swing chamber pump. The pilot gas can be delivered via a pilot gas line 65 and controlled by controller 70. The pilot gas can share a common source with power gas.

In further embodiments, although not shown, a dynamic fluid level detecting device and a downhole temperature sensor can also be installed to provide dynamic fluid level information. This system can then operate using semi-closed-loop processing including the returned spent power gas and casing gas via the annular space. By integrating the above mentioned dynamic fluid level information with a downhole temperature sensor, an operator should be able to estimate bottom hole flowing conditions to avoid flashing of the pumped wellbore fluid and determine the sub cool degree for a hot fluid producing well.

Figure 2:
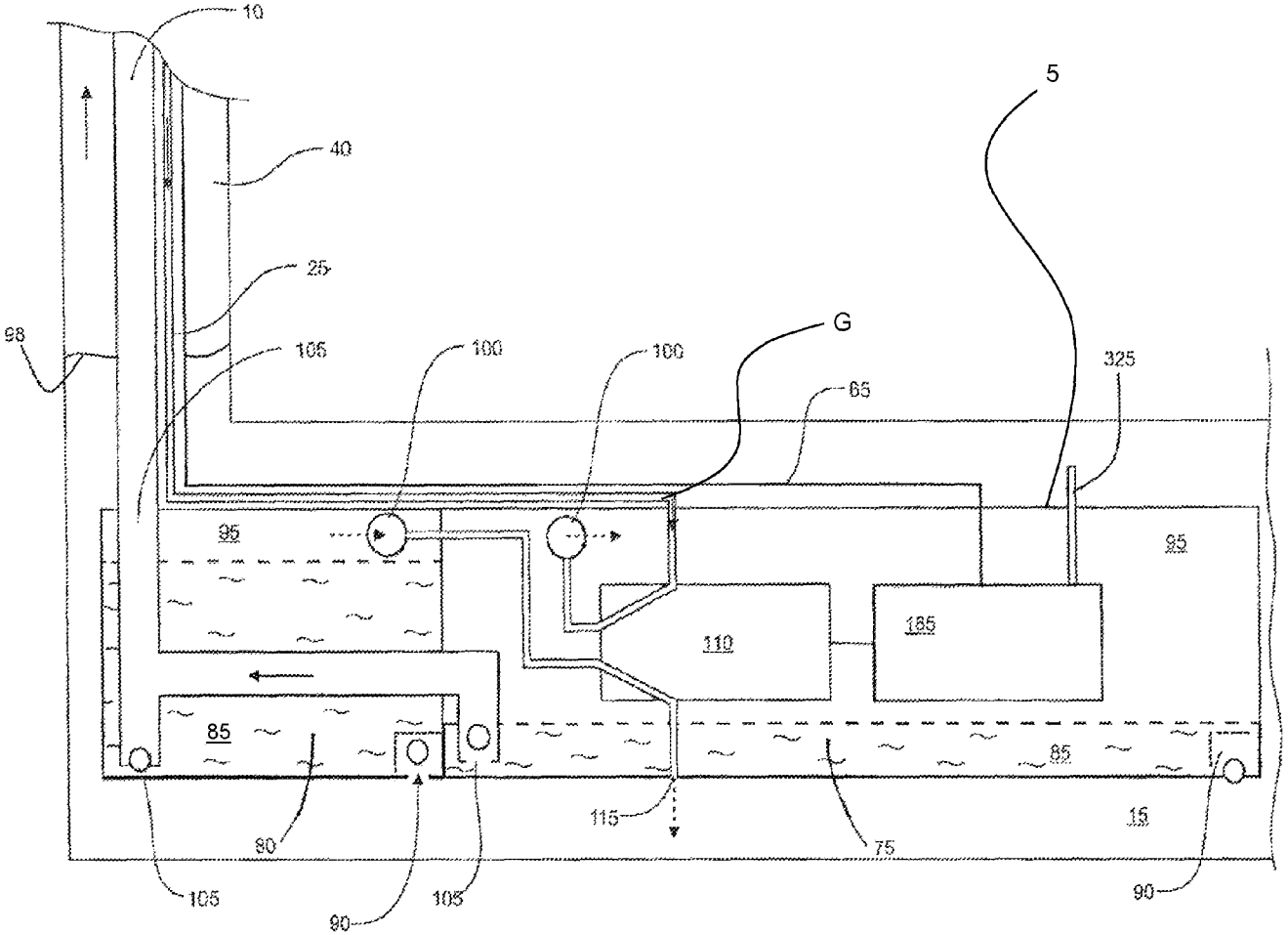
FIG. 2 is a representative drawing of the swing chamber pump of FIG. 1, the pump having two fluidly separate pump chambers, a switch, a pilot assembly and various associated equipment for injecting and venting a power gas and a pilot gas.

With reference to FIG. 2, embodiments of the swing chamber pump 5 comprise fluidly separated first and second pump chambers 75,80 that are fluidly connected to the wellbore 15 for alternately filling and producing wellbore fluids. Each of the first and second pump chambers 75,80, in a first half of the swing cycle, passively receive wellbore fluids and stores the fluids therein. Each of the first and second pump chambers 75,80, in a second half of the swing cycle, is pressurized with power gas to urge collected fluids into the production string 10.

As shown, each of the first and second chambers 75,80 is in one way, fluid communication with the wellbore 15, for passively receiving wellbore fluids and storing fluids in a lower portion 85. The lower portion 85 passively receives the wellbore fluids through a fluid inlet 90. The stored fluids are then conveyed from the lower portion 85 to the production string 10, under the pressure of the power gas G which is directed to enter into an upper headspace portion 95 of the chamber such as through a gas valve 100. Accumulation of the power gas G in the active chamber respectively causes the stored fluids in the lower portion 85 to be forced or conveyed out of the chamber.

In an embodiment, the stored wellbore fluids are conveyed to the production string 10 through a fluid outlet 105. As the power gas G enters into the active chamber, increasing pressure therein causes the temporarily stored fluids to be forced out of the active chamber. To prevent the produced fluids from flowing back into the wellbore 15, the fluid inlet 90 comprises a uni-directional check valve, such as a ball check valve.

Power gas G is alternately directed to a pump chamber and then exhausted or expelled from the respective filling and producing chambers using a switch 110. A variety of switches can be employed. Embodiments of two forms of switches are detailed herein. In one embodiment, detailed in FIGS. 6-9D, a linear switch is provided, having a linear valve to coordinate flow of power gas and expelling of spent gas. The linear switch embodiment further implements a pilot assembly 185 using a source of pilot gas conducted from the surface. In another embodiment, a rotary switch is illustrated, using a rotary valve for coordinating power gas and return gas flows and using a fluid level float and drive assembly, having no need for a pilot assembly 185 and associated equipment.

Switch 110 alternately directs the power gas G into either the first pump chamber 75 or the second pump chamber 80. Thus, when the switch 110 directs the power gas into the first chamber 75, the stored fluids therein are conveyed into the production string 10. Simultaneously, the second chamber 80 is permitted to passively receive wellbore fluids from the wellbore 15 as the spent power gas therein is expelled into the annular space 40 through a return gas port 115. That is, as wellbore fluids enter into one of the first or second chambers 75,80 the wellbore fluids temporarily stored in the other of the second or first chambers 80,75 are conveyed into the production string 10.

Applicant notes that during filling and expelling of spent power gas, the lower and upper headspace portions of the chambers are openly exposed to wellbore pressure. Accordingly, there may be instances where the pressure in the upper headspace portion may be substantially the same as the wellbore pressure. Thus, to ensure that the pressure within the upper headspace portion remains lower than the wellbore pressure, although not shown, a return gas port 115 can be fluidly connected to a lower pressure region in the annular space 40 such as above the dynamic fluid level 98.

In order to prevent wellbore fluids inside producing tubing 10 from flowing back into the lower portion 85 of the two chambers, the fluid outlet 105 comprises a uni-directional check valve, such as a ball check valve.

The pump 5 is connected to the production string 10 and has a pump axis substantially coaxial with a wellbore axis. Thus, as is commonly encountered during operations, the housing of the pump 5 can potentially come to rest or land in any random rotational orientation. Rotational orientation is a challenge for wellbore fluid flow management, the fluid being generally liquid which flows to low lying areas and any gas residing thereabove. Even with detailed drilling trajectory data and careful running operation, a skilled person would understand that it is very difficult to ensure a conventional pump lands in an desired orientation, particularly when it is desired that a gas valve land orientated at a top of a chamber, and with a fluid outlet valve orientated at a bottom of the chamber, especially considering how long a wellbore can be and how complicated a trajectory the pump has traversed.

Further, in a pump employing a gas-actuating principle, wellbore fluid outlet valves need to reliably be positioned to be in constant fluid communication with the wellbore fluids, particularly those stored in the lower portion of the filling chamber. If not so arranged, there can be certain operational situations where the outlet valve is not resting in the fluid and power gas is ineffective to drive stored wellbore fluid into the production string, decreasing the effectiveness of the gas-actuation mechanism.

Applicant also notes that in order to maximize the force exerted by the power gas on the wellbore fluids stored in the chamber, and to ensure effective volumetric use of the available chamber volume while avoiding power gas breakthrough, the power gas entering the chamber should be segregated from and above the stored wellbore fluids. In other words, it is advantageous to prevent the power gas from bubbling through any stored fluids in the chamber.

Accordingly, and similarly, gas valves to the chambers are arranged to be self-orienting to be in constant fluid communication with an upper headspace portion of the chamber to ensure that when introducing and releasing the chamber pressure, it is a gas phase (ie. spent power gas) being released.

Figure 3:
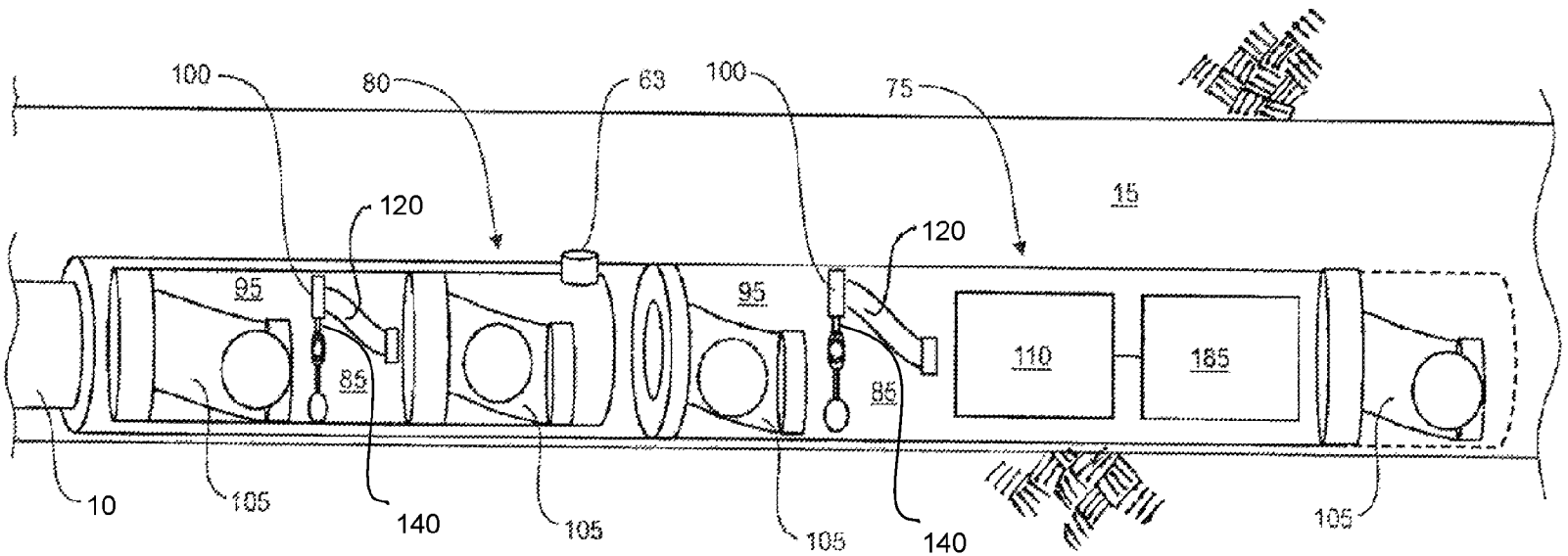
FIG. 3 is a side view of the swing chamber pump of FIG. 2, illustrating a first pump chamber housing the switch, pilot assembly and a second pump chamber, each of the chambers having a fluid inlet, a self-orienting gas valve and a self-orienting fluid outlet.

Accordingly, and as shown in greater detail in FIG. 3, the gas valve 100 can be a self-orienting gas valve 100 and the fluid outlet 105 can be a self-orienting fluid outlet 105. The connections between the switch 110 and the gas valve 100 are not detailed. In this embodiment, one can see that the second pump chamber 80 is situate within the pump 5, downstream of the first chamber 75, forming a fluid annulus thereabout for conducting wellbore fluids from the first chamber 75 to the production tubing 10. Thus, the wellbore fluid inlet port or ports for the second chamber are implemented with one or more conduits 63 that span the pump chamber annulus. In this embodiment, a swing chamber switch 110 and switch pilot assembly 185 is shown housed in the first pump chamber 75.

As shown, the self-orienting gas valve 100 places the gas outflow end 130 (shown in closer detail in FIG. 4), in the upper headspace portion 95, regardless of the orientation of the pump 5, ensuring that when releasing spent power gas, only the gas phase is released. Similarly, the self-orienting aspect ensures that the fluid outlet 105 is always located in the lower portion 85 to remain in the generally liquid portion of the wellbore fluid, avoiding breakthrough of the power gas G into the production string 10.

Figure 4:
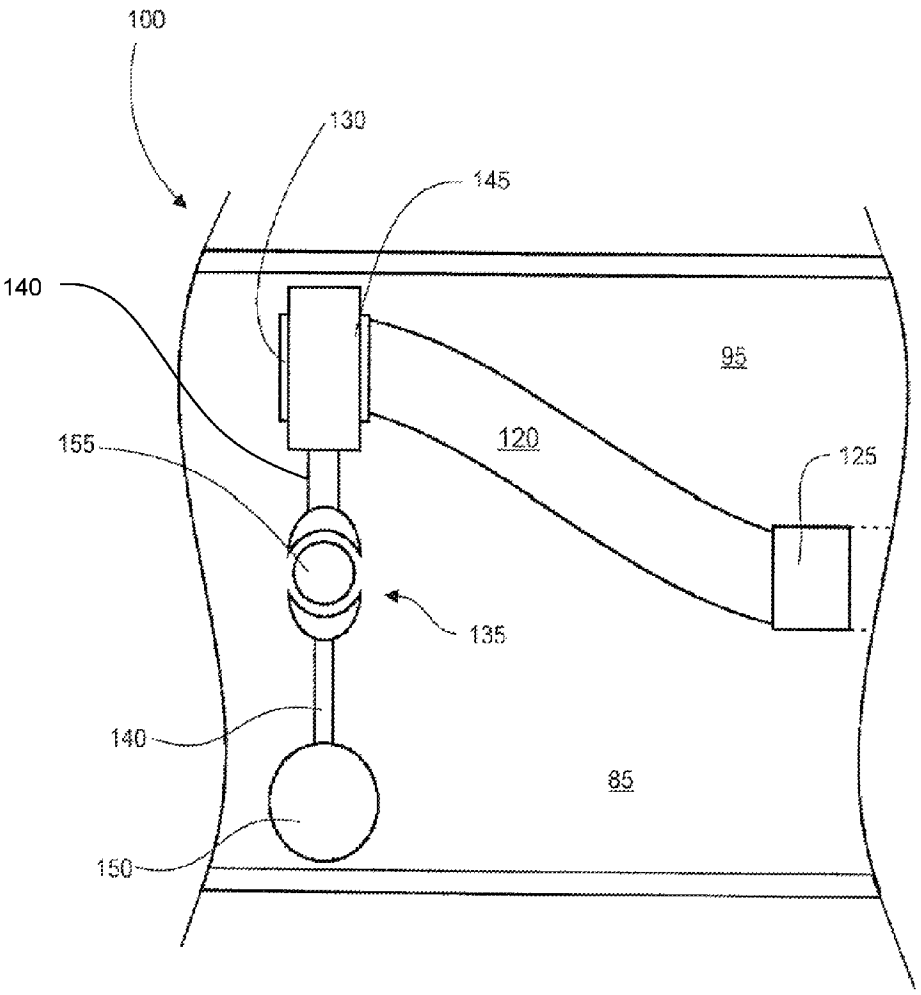
FIG. 4 is a side view of an embodiment of the self-orienting gas valve of FIG. 3, illustrating a self-orienting support supporting a gas conduit for fluidly communicating the power gas therethrough.

With reference to FIG. 4, the self-orienting gas valve 100 self-orients to remain fluidly connected to the upper headspace portion 95 of the chamber, ensuring that the power gas G enters and exits the upper headspace portion 95 directly and avoid liquids in the lower portion 85 of the respective chamber 75 or 80.

As shown, the gas valve 100 comprises a gas conduit 120, such as flexible tubing, having an first gas interface 130 urged to the upper headspace portion 95 and a second gas interface 125 alternately connected to the power gas for receiving the power gas and to the wellbore for expelling the power gas. The second gas interface 125 is generally fixed to the structure of the pump 5.

As shown, the first gas interface 130 is supported on a self-orienting support 135 such as a gimbal, which constantly ensures that the first gas interface 130 rotates upwardly to a position within the upper headspace portion 95, minimizing situations where the first gas interface 130 would reside partially or otherwise submerged in the wellbore fluids stored in the lower portion 85. The self-orienting support 135 can comprise an orienting member 140 extending across a diameter of the chamber 75 and rotatable about an intermediate or central pivot 155 supported from the structure of the chamber 75 or 80. The member 140 is rotatable about the pump axis that is also coaxial with the wellbore axis. The wellbore axis is generally horizontal although it is understood that the wellbore can be somewhat tortuous. The member 140 supports a float 145 at a first conduit end and a weight 150 at an opposing end. The member 140 is freely rotatable about the pivot 155 depending on the combined influence of the float 145, tending to rotate upwardly, and weight 150, tending to rotate downwardly.

As one of the chambers 75 or 80 fills with wellbore fluids, the buoyancy of the float 145 in combination with the weight 150, due to the effects of buoyancy and gravity respectively, constantly orients and positions the first gas interface 130 of the self-orienting gas valve 100 within the upper headspace portion 95.

As shown, the first gas interface 130 is supported by the float 145 at the first conduit end of the member 140. In order to minimize the resistance to rotation by torsion imposed by the flexible tubing 120, the movable first gas interface 130 can be rotatably supported in the first conduit end such as within a torus form of float 145, in order to permit relative rotation of the first gas interface 130 and the float 145. The bushings or bearings permitting free rotation can be added between the float 145 and first gas interface 130 to reduce friction therebetween and enhance free rotation.

In an embodiment where the pump chambers 75,80 are arranged coaxially in the wellbore (See FIG. 3), the gas conduit 120 extends generally axially away from the first gas interface 130 to the second gas interface 125, and the orienting member 140 rotates in a plane transverse to the wellbore. The gas conduit 120 can be rotatably supported to the first conduit end for permitting free rotation thereof.

Figure 5:
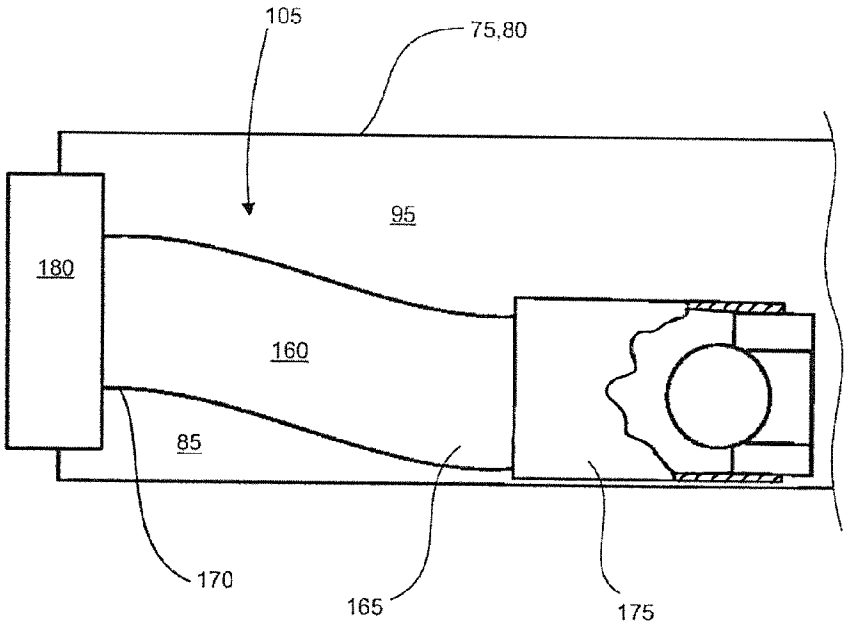
FIG. 5 is a partial side cross-sectional view of an embodiment of the self-orienting fluid outlet of FIG. 3, illustrating a fluid conduit having a uni-directional valve.

FIG. 5 illustrates the self-orienting fluid outlet 105 in greater detail. As shown, in an embodiment, the fluid outlet 105 comprises a fluid conduit 160, such as flexible tubing, having an inflow end 165 in fluid communication with the lower portion 85, and an outflow end 170 fluidly connected to the production string 10 for conveying the wellbore fluids to the surface. A drop down valve body 175 can be supported at the inflow end 165 for ensuring that, regardless of the orientation of the pump 5, the inflow end 165 will consistently remain in fluid communication and substantially submerged within the stored wellbore fluids. The drop down valve body 175 is manufactured with or additionally weighted to be sufficiently heavy enough to ensure that the valve body 175 will always have a higher effective density than that the stored wellbore fluids so as to sink and be urged by gravity to the lower portion 85 of the respective chamber 75 or 80.

In an embodiment, and as shown, the outflow end of the flexible tubing 160 can be affixed to a connector 180 and fluidly connected to the production string 10.

In another embodiment, the drop down valve body 175 comprises a uni-directional check valve, such as a ball check valve, for one-way fluid communication from the lower portion 85.

Linear Valve

Figure 6:
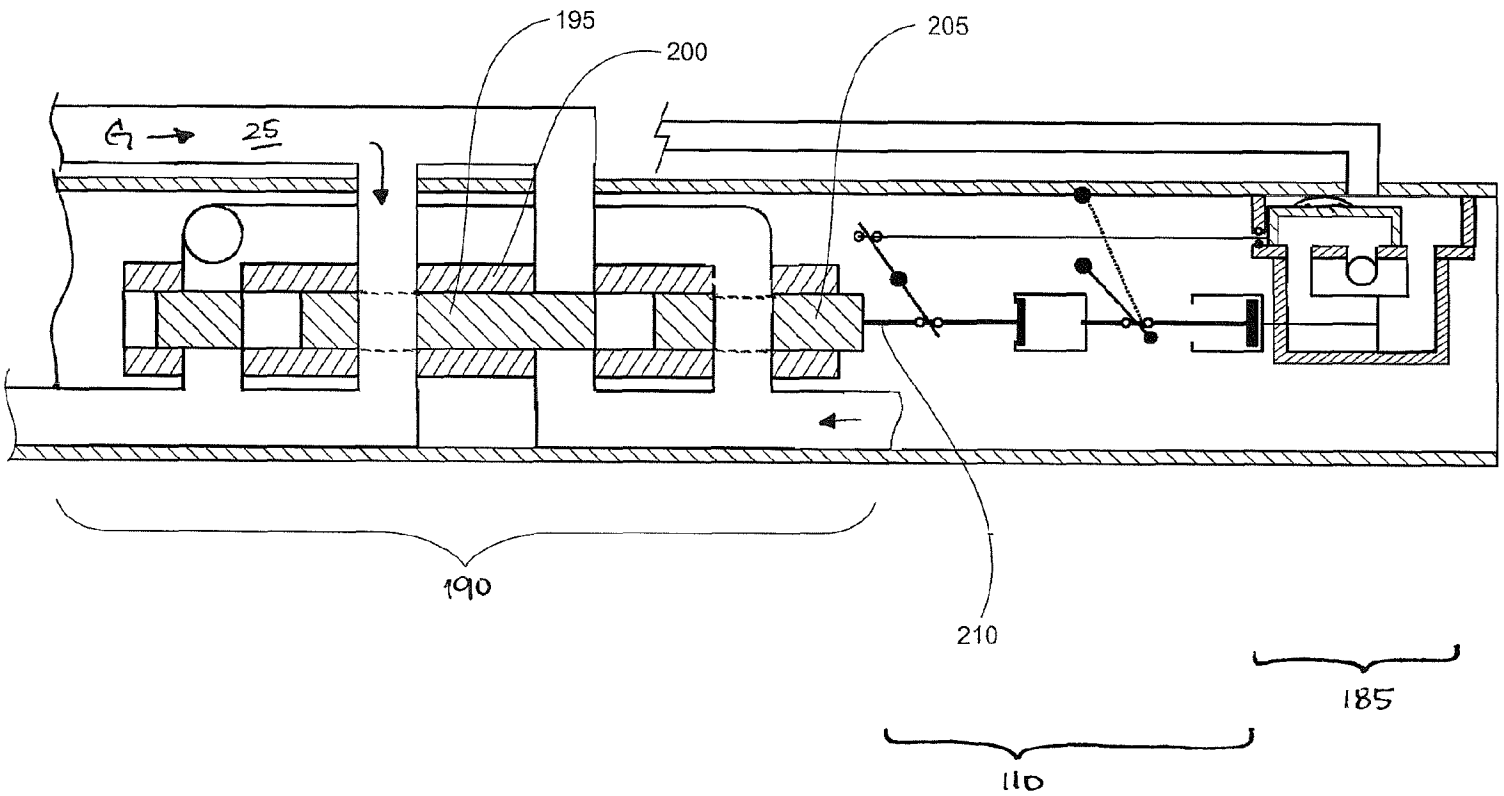
FIG. 6 is an overall side schematic drawing of a swing chamber pump having a linear valve actuated by a linear switch which is driven by a pilot assembly.

Referring back to FIG. 2 and with reference to FIG. 6, the switch 110 (also referred to as an intermediate driven member 110) is operable between a first position and a second position for alternately directing the power gas G into either one of the first or second pump chambers 75,80. As shown in the linear switch of FIGS. 6 through 9D, a pilot assembly 185 is provided for actuating the switch 110 with a quick acting two-position operation. The provided switching arrangement, for directing power gas G between the first pump chamber 75 and second pump chamber 80, ensures no appreciable fluctuations on the downhole pressure environment while controlling fluid flow in the production string 10.

Figure 7A:
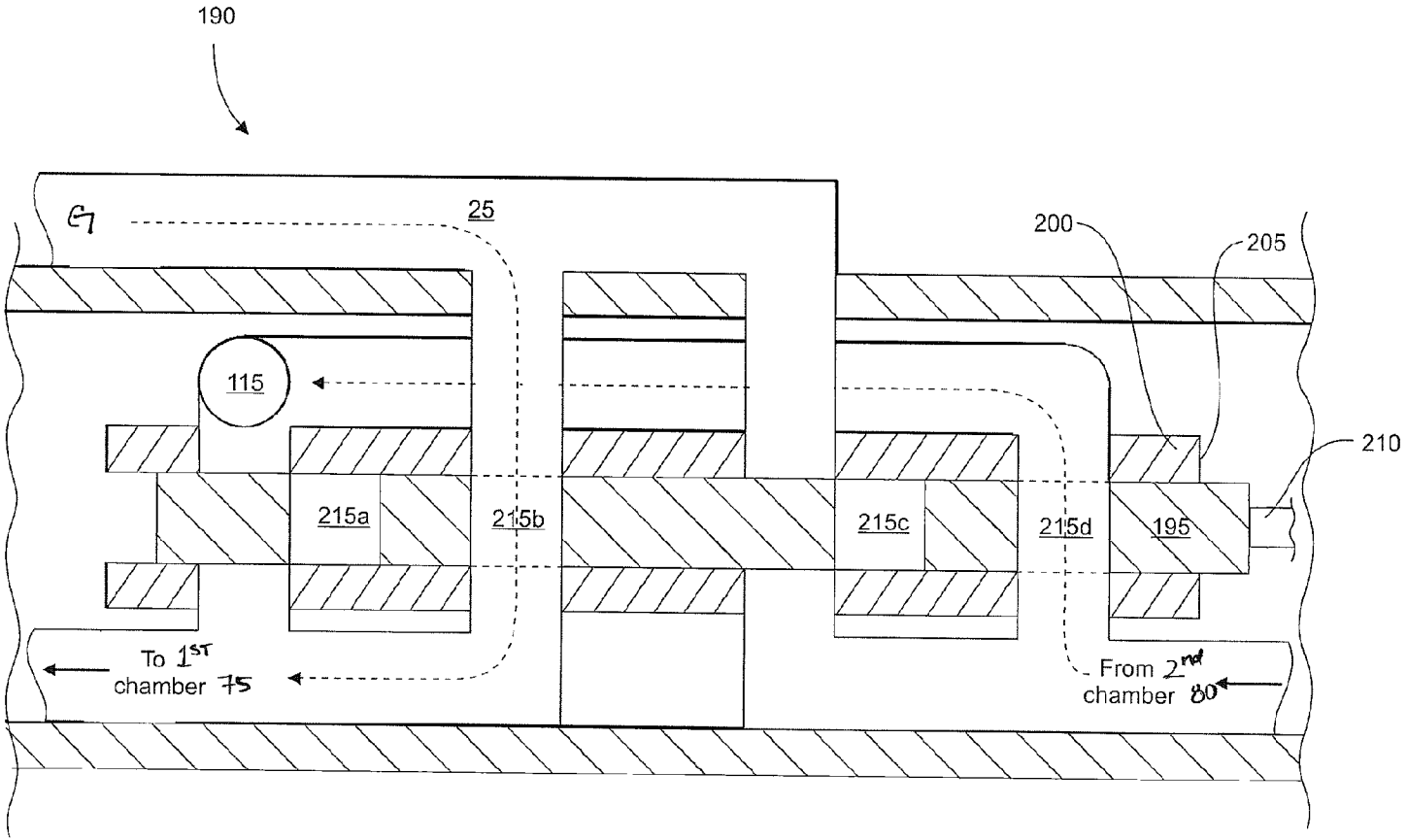
FIG. 7A is a partial side cross-sectional view of the embodiment of the linear valve of FIG. 6 in a first position, illustrating four ports, a power gas line and a spent power gas return line.
Figure 7B:
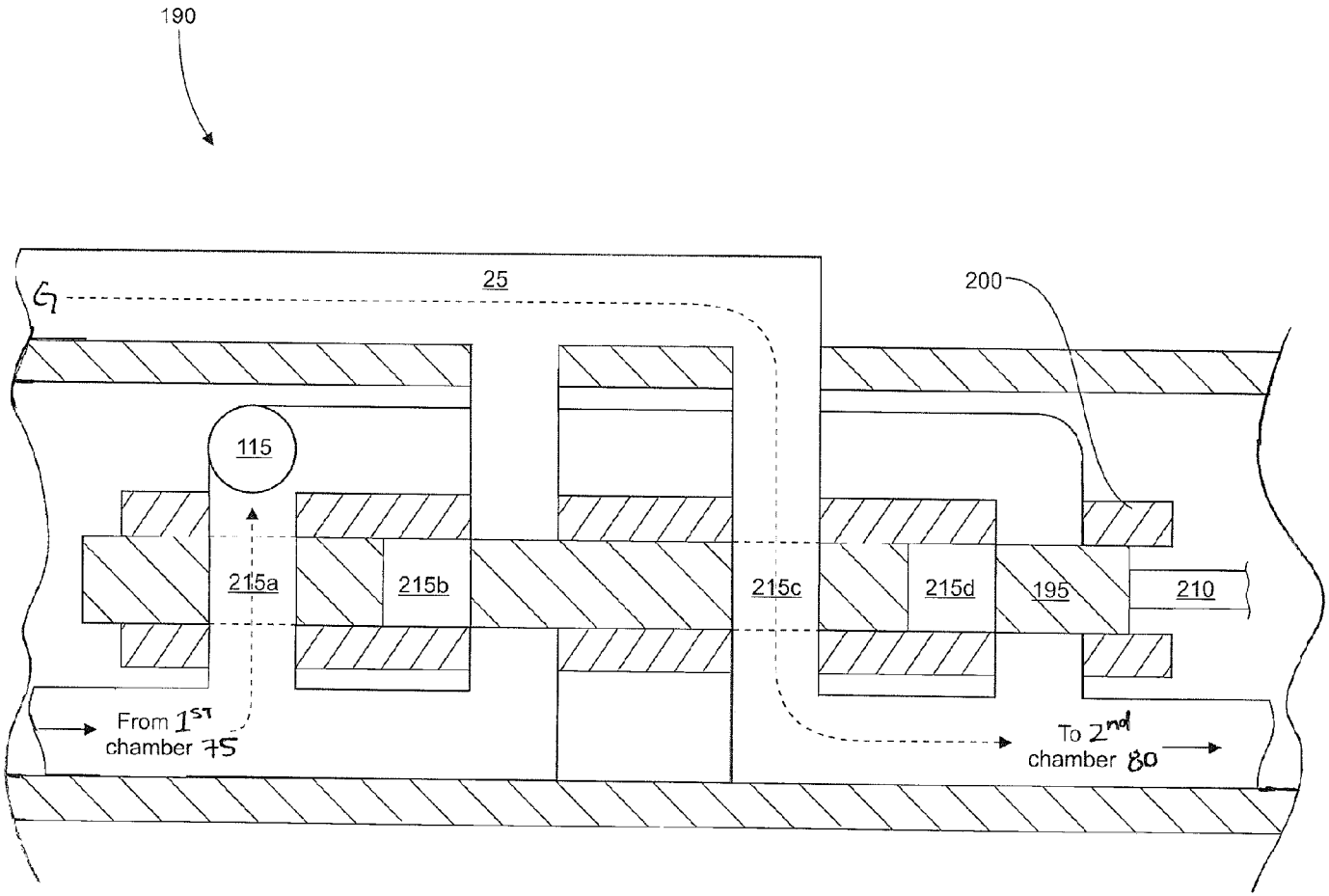
FIG. 7B is a partial side cross-sectional view of the embodiment of the linear switch of FIG. 7A, illustrating the linear valve in its second position.

With reference to FIG. 6 and the opposing, alternating operational positions shown in FIGS. 7A and 7B, a linear embodiment of the switch 110 can have a linear valve 190 having a valve core 195 which reciprocates between a first position (FIG. 7A) and a second position (FIG. 7B) within a bore of a valve body 200. The core 195 has a pilot end 205 which is operatively connected to a core rod 210 of the pilot assembly 185. The valve core 195 has four ports 215*a*,215*b*, 215*c*,215*d* spaced axially therealong for alternately aligning with the power gas line 25 and the return gas vent port 115. Ports 215*a* through 215*d* fluidly connect the power gas line 25 with either the first or second chamber 75 or 80 and alternately fluidly connecting the first and second chambers 75,80 with the return gas vent port 115, depending on the position of the core 195.

The valve core 195 reciprocates within the valve body 200 to align and/or misalign the ports 215*a* to 215*d* with the power gas line 25 or the return gas port 115. The core 195 is movably sealed within the body 200 and can move longitudinally therein. The switch body 200 can be supported from the structure of one of the chambers 75,80.

Shown in greater detail, FIG. 7A illustrates an embodiment where the valve 190 is arbitrarily defined as being in its first position with the core 195 positioned such that the second pump chamber 80 is releasing and expelling any spent power gas to return port 115 and receiving wellbore fluids from the wellbore while, simultaneously, power gas G is directed along a first path to be applied to any stored wellbore fluids in the first pump chamber 75 for conveyance to the production string 10. As shown, the switch core 195 is positioned so that port 215*b* is aligned to be in fluid communication with the power gas line 25, directing the power gas G along the first path into the first chamber 75. Simultaneously, port 215*d* is aligned to be in fluid communication with the return gas port 115, allowing any spent power gas in the second chamber 80 to be expelled into the annulus 40 and return gas line 45 at surface. As can be seen, port 215*a* is misaligned with the return gas port 115 and port 215*c* is misaligned with the power gas line 25, isolating the power gas line and return gas line from the off-cycle chamber.

Although not shown in FIG. 7A, the power gas entering the first pump chamber 75 passes through the self-orienting gas valve 100 to enter into the upper headspace portion 95 of the first chamber 75 (refer to FIG. 2), thereby displacing or causing any wellbore fluids therein to be conveyed into the production string 10 through the self-orienting fluid outlet 105.

In a similar fashion, wellbore fluids can passively enter into the lower portion 85 of the second chamber 80 as the spent power gas in the second chamber 80 is permitted to be expelled therefrom through the return gas port 115.

FIG. 7B illustrates when the switch 190 is in its second position and the first chamber 75 is permitted to receive wellbore fluids from the wellbore while the stored wellbore fluids in the second chamber 80 are conveyed to the production string 10. As shown, the valve core 195 is positioned so that port 215*c* is aligned to be in fluid communication with the power gas line 25, directing the power gas along a second path to enter into the second chamber 80. Simultaneously, port 215*a* is aligned to be in fluid communication with the return gas port 115, allowing the power gas in the first chamber 75 to be expelled into the annulus 40. Ports 215*b* and 215*d* are misaligned with the power gas line 25 and the return gas port 115 respectively, isolating the first pump chamber 75.

When the valve 190 is in its second position, wellbore fluids are permitted to enter into the lower portion 85 of the first chamber 75, while power gas is injected into the upper headspace portion 95 of the second pump chamber 80 to convey stored wellbore fluids from the second chamber 80 to the production string 10.

As shown, the position of the valve core 195 determines which of the first or second pump chambers 75,80 receives power gas to convey wellbore fluids stored therein to the production string 10 while simultaneously permitting the other of the second or first pump chambers 80,75 to dump or expel earlier utilized and spent power gas so as to receive wellbore fluids from the wellbore.

Linear Switch and Pilot Assembly

Figure 8:
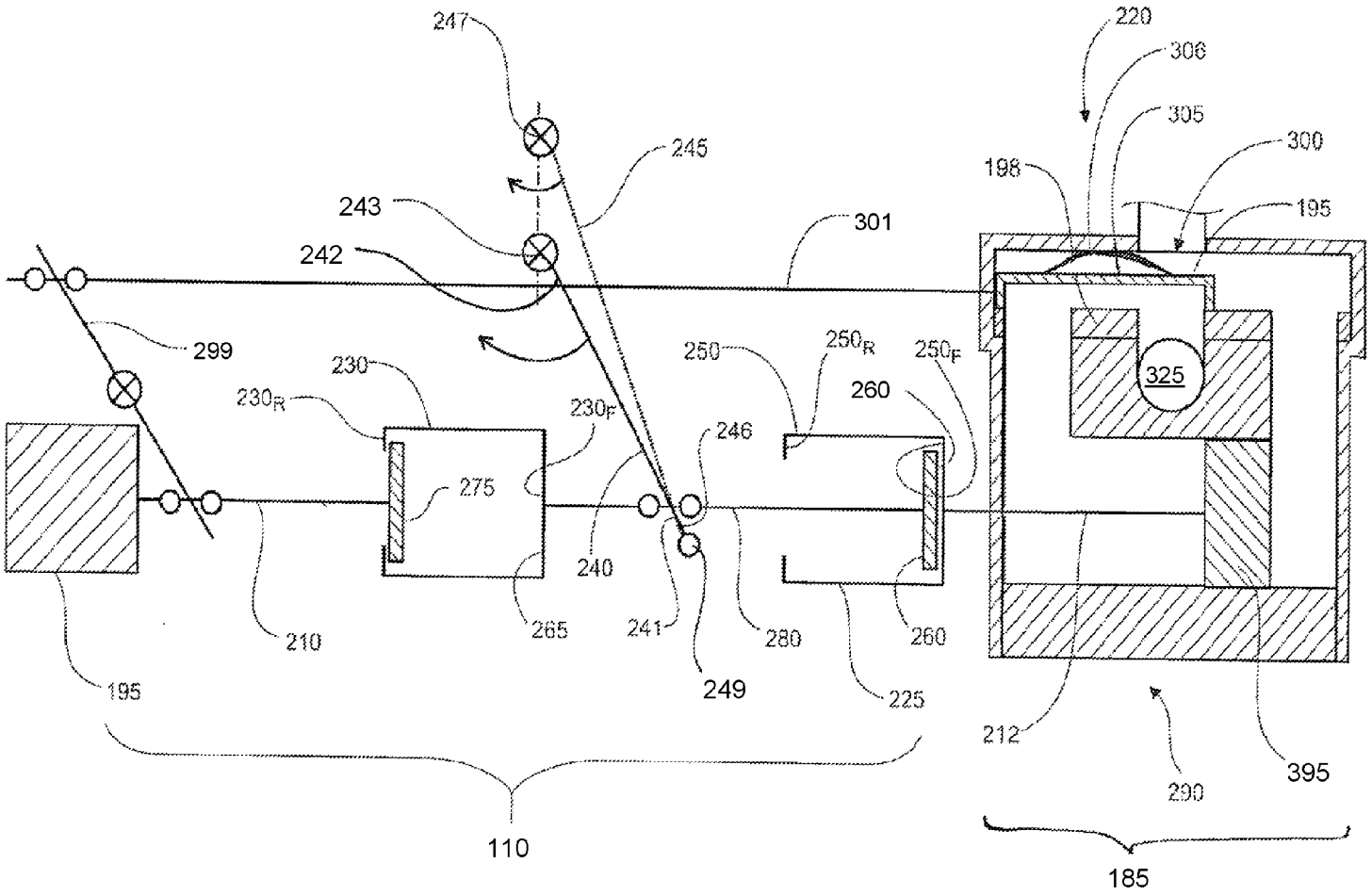
FIG. 8 is a partial side cross-sectional schematic drawing of an embodiment of the pilot assembly and linear switch of FIG. 6, the pilot assembly having a port for receiving power gas, a diverter, a bi-directional piston and a pilot gas return port, and the switch having baffles, a snap member, a snap spring, and rods for engaging the linear valve.

Referring back to FIG. 6 and also in more detail in FIG. 8, an actuator including pilot assembly 185, controls the switch 110 to determine which chamber the power gas is directed to, and to actuate with some rapidity, to avoid partial opening or closing of the ports 215*a*-215*d*, which can result in gas loss during the transition between the first and second positions of the valve core 195. As shown, the pilot assembly 185 and double-acting, or bi-directional piston 395 piston 395 is connected to the switch 110 for driving or linearly actuating the switch 110 through a back and forth snapping action which is described in greater detail hereinbelow. From FIGS. 7A and 7B, one understands that actuation of the switch 110 to its first actuation position directs the power gas along a first path and into the first pump chamber 75. Actuation of the switch 110 into its second actuation position alternately directs the power gas along a second path and into the second pump chamber 80.

With reference to FIG. 8, in an embodiment, the pilot assembly 185 functions to actuate switch 110, together providing an axial or linear, two-position snapping action of the valve core 195 in both directions; namely actuating the valve core 195 in either the first position of FIG. 7A or in the second position of FIG. 7B. As described in greater detail below, the two-position snapping action of the switch 110 includes a latency device or operation for providing a period of delay or dwell between the reciprocation of the valve core 195 between the first and second positions. The dwell allows the active chamber to passively fill with wellbore fluids. The switch 110 converts a continuous action (of the injection of the pilot gas) into a two-position delay snapping action. Although periods of delay between each position is increased, the transition time from snapping from one position to the other is rapid.

The pilot assembly 185 has a two-stage operation in each direction, namely a first latency stage, without actuation, and a second actuation stage. In an embodiment, and as shown, the pilot assembly 185 comprises a double-acting linear actuator 220 which is operatively connected to the switch 110. The switch 110, acting as a latency device, comprises at least two baffles, first proximal and second distal baffles 225 and 230; and three rods, a distal core rod 210 and a proximal core rod 280; and a connecting rod 212. The baffles and core rods of the switch cooperatively act to interrupt the normal continuous linear action of the actuator 220 and instead provide the snapping between the first latency stage and the second actuation stage of the core 195 in both directions. The cooperative action of the baffles 225,230 and core rods 210,280, ensure that reciprocation of the valve core 195 occurs in sudden snap action between its first position and its second position, while increasing a period of delay.

In an embodiment, and as shown, the switch 110 can comprise an over-center device that accepts linear actuation during the latency stage and then actuates, or snaps, to an actuation stage. In this embodiment, the over-center device comprises a rigid member, such as a snap bar 240, generally extending away from the core rod 280. The snap bar 240 has a translation end 241 connected and freely movable along with the core rod 280, and an opposing pivot end 242 pivotally mounted to the chamber 75 or 80 at a first anchor point 243. A biasing member, such as a snap spring 245, also has a translation end 246 which is connected to the translation end 241 of the snap bar 240 at a driven point 249. The snap spring 245 is also mounted at a second anchor point 247 to the chamber 75 or 80. The second anchor point 247 is laterally spaced away from the first anchor point 243. As shown, both snap bar 240 and snap spring 245 are moveably engaged to the core rod 280 between the baffles 225 and 230 at the driven point 249.

Generally, in operation, the actuator 220 is operatively connected by connecting rod 212 to proximal baffle 225 of the switch 110 and thus any movement of the actuator 220 is transferred to a corresponding movement of the baffle 225. However, the movement of proximal baffle 225 is not immediately transferred to a corresponding movement of distal core rod 210.

Figure 9A:
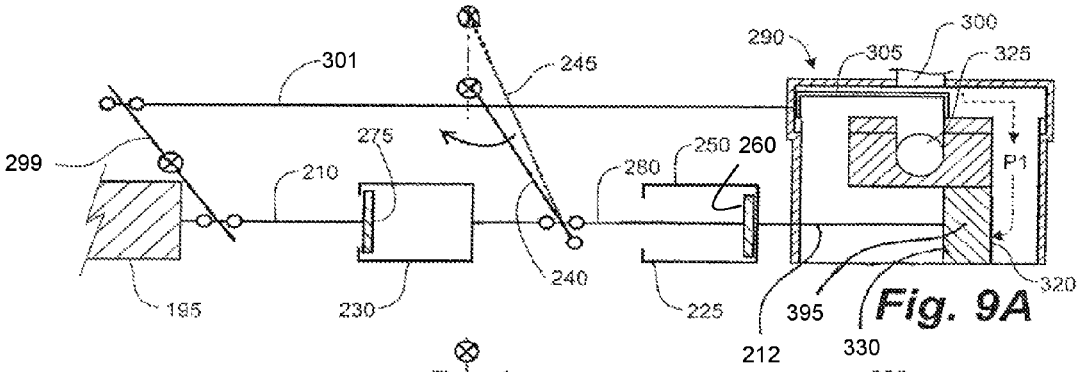
FIG. 9A is a schematic drawing of the linear switch and pilot assembly of FIG. 6 in their first position, a diverter directing a pilot gas towards a bi-directional piston along a first path.

As shown in FIG. 8 and FIG. 9A, the first proximal baffle 225, closest to the actuator 220, comprises a cage 250 having axially-spaced delimiting stops, a first drive or forward stop 250F and a a-second drive or return stop 250R. The proximal core rod 280 is fit with a drive interface, catch or plate 260 that alternately engages the spaced forward (first) and return (second) drive stops 250F, 250R. In this embodiment, the connecting rod 212 is connected to the cage 250. Thus, for moving the valve core 195 to the second position, movement of the actuator 220 drives the cage 250 steadily forward. During the latency stage, the forward stop 250F engages plate 260 and drives the proximal core rod 280 forward. The snap bar 240 is engaged to the proximal core rod 280 and is translated with the proximal core rod 280. The snap spring 245 connected to the snap bar 240 at the driven point 249 applies compression to the snap bar 240, until the snap bar 240 over-centers and the snap spring 245 suddenly drives the snap bar 240 and proximal core rod 280 forward (shown in FIGS. 9B and 9C).

As shown, the proximal core rod 280 is also connected to distal cage 230. Distal cage 230 also comprises axially-spaced delimiting stops, a forward stop 230F and a return stop 230R. The distal core rod 210 is fit with a catch or plate 275 (also referred to as switch interface 275) within the cage 230 that alternately engages the spaced forward and return stops 230F, 230R. The distal core rod 210 extends between the valve or switch core 195 and cage 230.

Figure 9B:
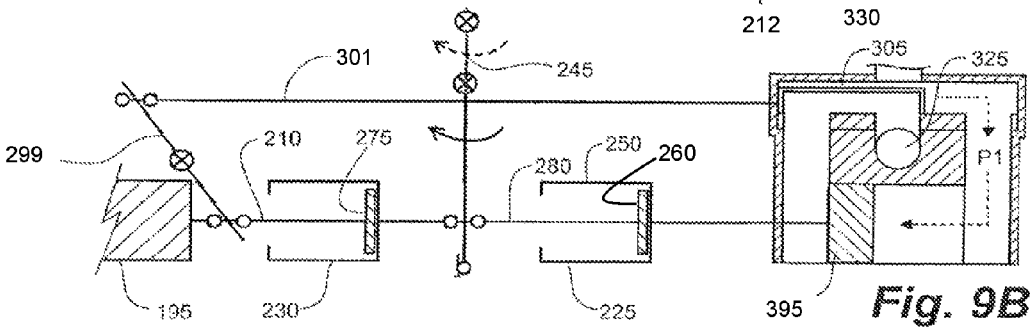
FIG. 9B is a schematic drawing of the embodiment of FIG. 9A, illustrating the snap bar overcoming a resistive force of the snap spring at about a midpoint of travel from its first actuation position to its second actuation position.

As shown in FIG. 9B, continuing the actuation of the switch 110, the proximal core rod 280 and cage 230 are driven forward, the forward stop 230F engages the plate 275 and drives the distal core rod 210 forward for switching the switch core from the first position to the second position.

As illustrated, the spacing between the forward and return stops 250F and 250R is spaced sufficiently to enable the snap bar 240 to reach its over-center position at about the time the space between stops 230F and 230R is consumed by the translating movement of the distal cage 230, placing the plate 275 at about the axial location of the forward stop 230F and ready to be actuated to shift the switch core 195 from its first to second position.

Figure 9C:
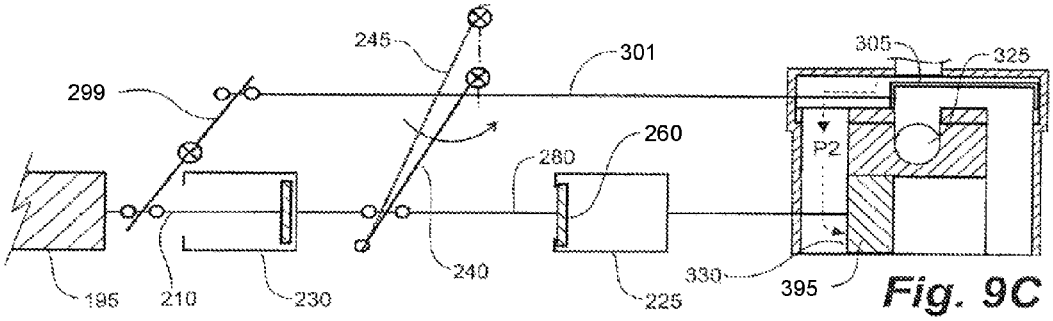
FIG. 9C is a schematic drawing of the embodiment of FIG. 9A, illustrating the switch and pilot assembly in their second position, and the diverter directing the pilot gas towards the bi-directional piston along a second path.
Figure 9D:
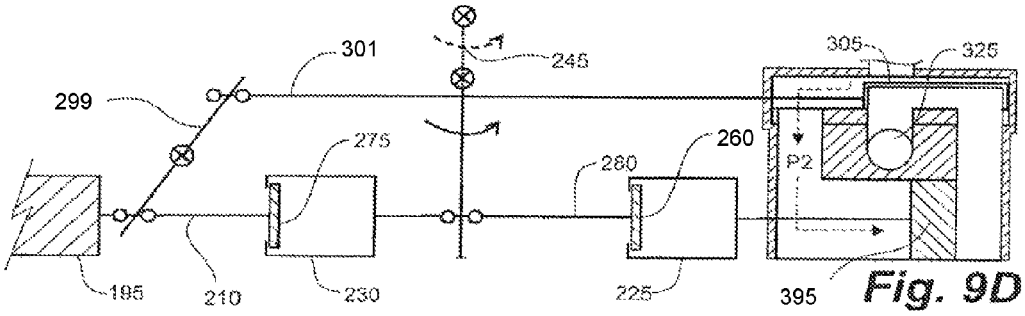
FIG. 9D is a schematic drawing of the embodiment of FIG. 9C, illustrating the snap bar overcoming the resistive force of the snap spring at about a midpoint of travel from its second actuation position to its first actuation position in an opposite direction.

Although persons skilled in the art would understand that many forms of bi-directional linear actuators would be sufficient to actuate the baffles 225 and 230, in the embodiment shown in FIGS. 8 through 9D, the actuator 220 is a pilot engine 290, such as that used throughout history for steam engines, having a bi-directional piston 395 that is operatively connected to proximal baffle 225 through connecting rod 212.

As shown, the pilot engine 290 operates using a pilot gas that can be injected by the surface system having a source of the pilot gas. More specifically, the pilot gas can be injected into the engine 290 through a port 300, ultimately to be directed for travel one of two directions to engage the bi-directional piston 395 for actuation thereof. A diverter 305 is used to direct the incoming pilot gas into one of the two directions of travel to actuate either side of the double acting piston 395. The diverter 305 is connected to a pilot rod 301 cooperating with the distal core rod 210 so as to detect the position of the valve core 195. The diverter 305 forms a portion of a head passageway that isolates and vents a passive portion of the double acting piston 395 and applies the pilot gas to the active drive side of the piston 395.

As shown in the embodiment of FIG. 8, the switch 110 further has a pivoted lever 299 that operatively connects the distal core rod 210 to the pilot rod 301. Thus, movement of the valve core 195 and distal core rod 210 results in a corresponding and opposing movement of the pilot rod 301. Thus as the valve core 195 shifts from the first position to the second position and vice versa, the pilot rod 301 signals the pilot engine 290 by shifting the diverter 305 that the pilot gas should reverse the pilot gas and actuate the pilot assembly to the opposing position.

As the skilled person would understand, cyclical switching of the pilot rod 301 results in cyclical switching of the actuator piston 395, switching of the valve core 195 between the first and second position and from the second to the first position. Note that a biasing member or leaf spring 306 retains the diverter 305 in sealing engagement with the pilot engine ports regardless of pump 5 orientation.

As shown in FIGS. 9A to 9D, with reference to the sequence of operation of the linear switch 190 and pilot assembly 185, the pilot gas first enters the engine 290 through the pilot gas port 300, and is directed in one of two directions of travel or path by the diverter 305. For illustrative purposes only, the bi-directional piston 395 is initially shown in the first actuation position for actuating the valve core 195 from the first position to the second position. The pilot gas is directed to act on the piston 395 to drive same towards the valve core 195.

As described above for FIG. 8 and also having reference to FIG. 9A, the pilot gas is shown to be directed along a first path P1 of travel for engaging a first piston face 320 of the bi-directional piston 395. From a previous cycle, gas from a second piston face 330 is fluidly communicated through the diverter passage, for venting through pilot gas return port 325.

The force generated by the pilot gas acting on the first piston face 320 causes the bi-directional piston 395 to move against frictional resistance and resisting force of the snap bar and snap spring 245. Connecting rod 212 moves cage 250. The cage's forward stop 250F drives proximal core rod 280 and distal cage 230 forward.

At the same time, movement of the proximal core rod 280 causes the snap bar 240 to enter into its latency stage and translate forward. The snap spring 245 is increasingly loaded as its effective length increases, applying increasing compression upon the snap bar 240 as the snap bar 240 approaches the unstable, over-center position. Distal cage 230 remains stationary and valve core 195 remains in its first position.

With reference to FIG. 9B, only when the bi-directional piston 395 nears the end of its path does the snap bar 240 over-center. The snap bar and spring 240,245 approach a point where the snap spring 245 applies the highest amount of compression to the snap bar 240 and are in an unstable condition. The snap spring 245, in its unstable condition has an amount of potential energy that is stored within that can be suddenly released. As shown, in FIG. 9B, when the snap spring 245 is at its highest tension and in its unstable condition, forward stop 230F of cage 230 is arranged to engage plate 275.

As shown in FIG. 9C, in part as a result of the system inertia and momentum present, the snap bar 240 is caused to over-center and enter into its actuation stage and caused to travel sufficiently beyond the point of being unstable to cause the sudden release of the compression therein. The movement of the proximal core rod 280 is transferred to the plate 275 and to core rod 210. This sudden release of energy translates to the snapping actuation of the snap bar 240 and the sudden actuation of the core rod 210, resulting in the reciprocation of the valve core 195. Distal core rod 210 finally and rapidly shifts the valve core 195 to the second position.

FIG. 9C also represents the commencement of the return portion of the cycle.

As shown, a pilot gas return port 325 permits any spent pilot gas downstream of the bi-directional piston 395 to escape therefrom. In an embodiment, the pilot gas return port 325 can be in fluid communication with the annulus 40 in the wellbore.

With reference to FIG. 9C, as the distal core rod 210 actuates the valve core 195 into its second position, the pivot 299 further transfers the core rod's movement into a corresponding movement of the pilot rod 301. This movement results in the actuation of the diverter 305, causing the diverter 305 to direct the pilot gas towards the second path P2 to engage the second piston face 330 and cause the bi-directional piston 395 to travel in an opposite direction. Pilot gas against the first and downstream piston face 320 is directed through the diverter 305 to pilot gas return port 325.

Similar to the action described in FIG. 9B, the travel of the bi-directional piston 395 in the opposite direction causes the return stop 250R or cage 250 to pull on plate 260. The proximal cage 225, core rods 210,280 and distal cage 230 translate away from the valve core 195. As the return stop 230R of distal cage 230 is still spaced from plate 275, the valve core has yet to be engaged. The proximal core rod 280 continues to move to cause the snap bar 240 to pivot in the opposite direction, once again increasing the tension or loading in the snap spring 245.

With reference to FIG. 9D, about when snap spring 245 is again in its unstable position, cage 230 engages the switch interface or piston plate 275. Again, due to the snap spring energy and inertia of the bi-directional piston 395 travelling in the opposite direction, snap spring 245 is caused to over-center and suddenly release its tension and cause a sudden or snap action of the snap bar 240, driving plate 275, the distal core rod 210 and attached valve core 195.

As shown in FIG. 9D, the sudden snapping action of the distal core rod 210 is translated into a sudden switching of the valve core 195 from its second position back to its first position. As previously described, the movement of the distal core rod 210 is translated into a corresponding movement of the pilot rod 301 and the diverter 305. Continued pilot gas injection ensures a subsequent cycle of the actuator 290 and the reciprocation of the valve core 195, resulting in an overall pumping action of the swing chamber pump 5.

During the latency stage, the movement of the proximal core rod 280 loads the snap bar 240. As the snap bar reaches its unstable position, it enters the actuation stage for moving the distal core rod 210 and actuating the valve core 195.

In an embodiment, the diverter 305 can be a pilot cap having a bell or leaf-type spring 306. The cap can be slidably moveable along the pilot assembly 290 while the leaf-type spring 306 provides biased engagement for sealing thereof.

Surface equipment using a pilot gas control device 70 (see FIG. 1) can control the pressure of the pilot gas being injected into the pilot assembly for controlling the frequency and speed at which the bi-directional piston 395 moves for satisfying a chamber fill time and lifting time requirement of the swing chamber pump.

Further, the length of the cages 230,250, being the spacing between delimiting stops, and the core rods 210,280 can also be designed to increase or decrease the residency time between the first and second positions of the valve core, and thus provide a time delay for controlling the cycling time of the swing chamber pump.

Applicant notes that the embodiments illustrated in FIGS. 1 to 9D show one arrangement of the first and second chambers 75,80, with the second chamber 80 being located coaxially inside the first chamber 75. In another embodiment, the first and second chambers 75,80 can be physically separate from one another, such as arranged coaxially in the wellbore.

However, the Applicant notes that regardless of what arrangement the first and second chambers 75,80 are in, both the first and second chambers 75,80 should be fluidly separate from one another and each have a fluid volume that is substantially the same, so that a time period for filling each chambers will be substantially the same.

Rotary Switch

A person skilled in the art would understand that several swing chamber pumps of the present disclosure can be used cooperatively with one production string 10, each pump sharing a power gas source, but each having its own switch and actuator, including their own pilot assembly. However, such an arrangement could become increasingly complicated as pilot gas lines would have to be connected to each pump.

Accordingly, in an embodiment, and with reference to FIGS. 10 to 14F, the pilot gas aspect is avoided by an arrangement having a rotary switch 251 including an intermediate driven member or drive assembly 255. The rotary switch 251 embodiment does not require a pilot gas to operate, using chamber fill level instead and includes means for enabled self-orientation to allow the power gas switching to function in a pump having a random landing rotation orientation. The rotary switch 251 and the drive assembly 255 provide an alternate option to the linear switch and pilot whether one or more swing pumps are implemented.

As described herein, the rotary switch 251 is actuated based on a level of fill in the swing chambers, directing power gas G first of all to empty a chamber when full and then switching to exhaust the power gas and enable influx of wellbore fluids when empty. Orientation of the apparatus is again automatic regardless of the orientation of the pump 5 on landing.

Figure 10:
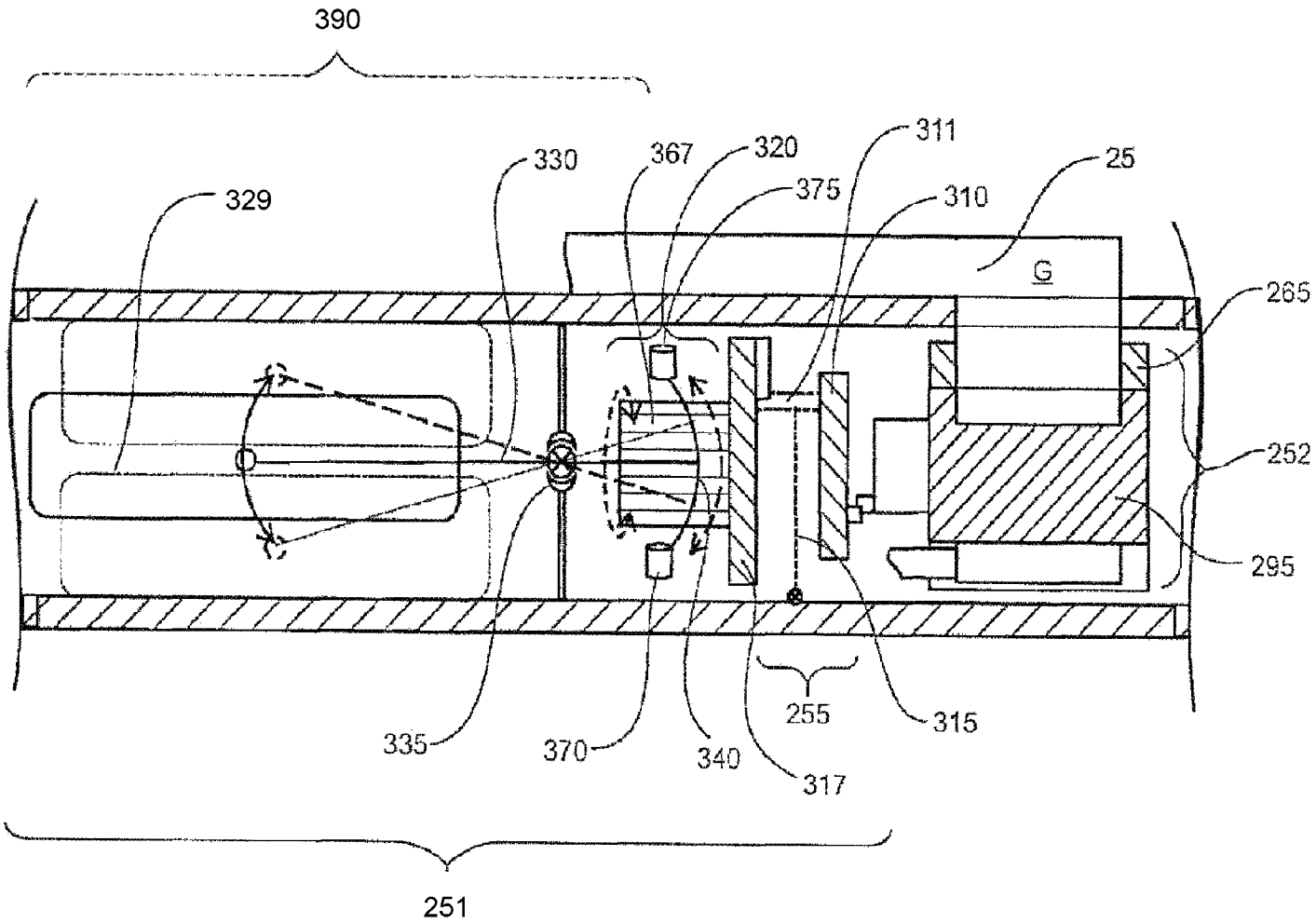
FIG. 10 is a partial side cross-sectional schematic drawing of an embodiment of rotary swing chamber pump having a rotary valve, a rotary switch having a float gear system for driving actuating the rotary switch.

Having reference to FIG. 10, the rotary switch 251 comprises a float system 390 for on/off control, and a rotary valve 252 having a rotary body 265 having a rotary valve core 295 for directing power gas G from power gas line 25 to either of the first pump chamber 75 or second pump chamber 80 and exhausting power gas from the other chamber 80,75 respectively.

The combination of the float system 390 and the drive assembly 255 ensures the rotary switch 250 operates regardless of the pump orientation by converting vertical up and down float movement of the float system 390 into a rotational oscillation of the rotary valve core 295. The drive assembly 255 translates the continuous up and down movement of the float system into rotational movement.

Figure 11B:
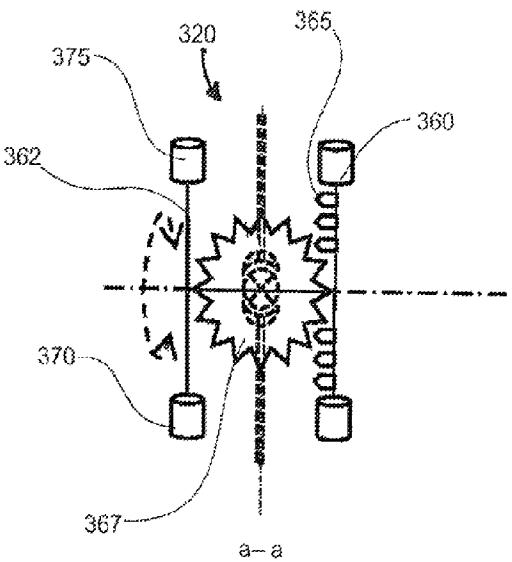
FIG. 11B is an axial representative view of an embodiment of the proximal end of FIG. 11A along the lines a-a, illustrating a pair of spaced apart rails, each rail having a float and a weight at opposing ends, and one rail supporting a gear rack for engaging the pinion gear.
Figure 11A:
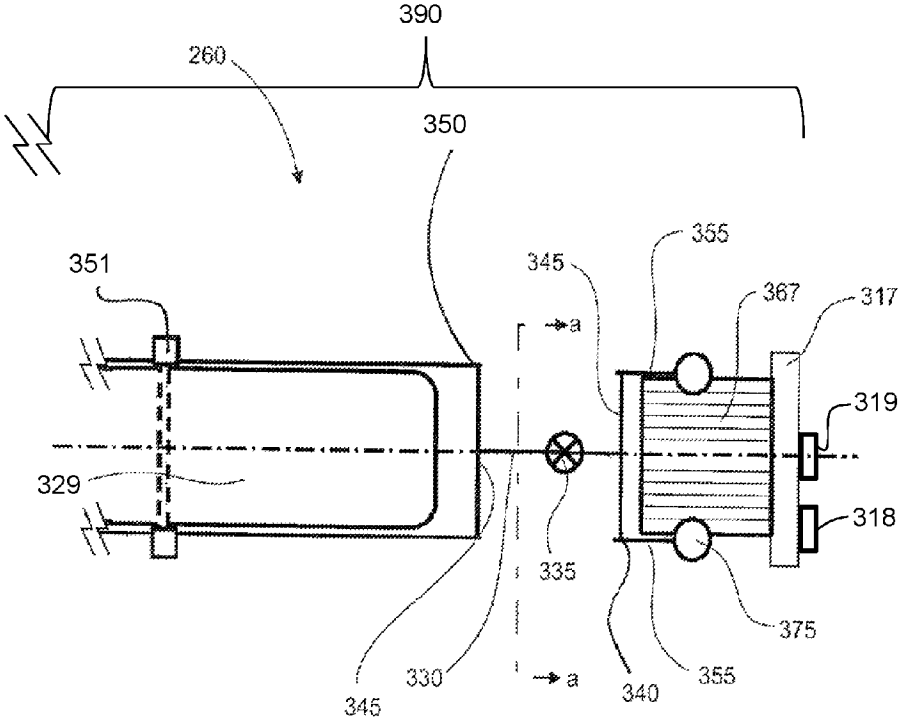
FIG. 11A is partial top representative drawing of the float gear system of FIG. 10, illustrating a float frame, a float at a distal end of the frame, and a proximal end adapted to operatively engage a pinion gear.

As shown in FIG. 11A, the float system 390 comprises a float 329 positioned at a first distal end 350 of a gimbal float fork or frame 330. The float frame 330 is pivotally and rotatably mounted at an intermediate mount 335, for rotation about a pump axis AP, and the second proximal end 340 thereof interfaces with the drive assembly 255. The float 329 is rotatably supported at about a balance point 351 in the frame 330 at the distal end 350. The float 329 remains substantially level as the frame 330 pivots about the mount 335 depending on the fluid level in the active chamber. The opposing proximal end 340 of the frame 330 is interfaced with the drive assembly 255 and ultimately to the valve switch core 295.

With receipt of wellbore fluids, the float 329 is buoyed upwardly, resulting in rising of the frame's distal end 350, a pivoting of the frame 330 at mount 335 and a lowering of the proximal end 340.

The proximal end 340 includes a generally upstanding gear rack 360 having gear teeth 365 as part of a gear system 320 for rotatably oscillating a pinion gear 367 in clockwise and counter clockwise directions, within a given operational angle as the float 329 goes up and down. The gear teeth 365 are generally in the shape of round, rod-like points for accommodating the angular change between the trajectory of the proximal end. The drive assembly 255 is also fit with spaced delimiting stops for controlling rotation of the rotary valve core 295.

A gear system 320 (including the pinion gear 367) and drive assembly 255 operatively connect the float system 390 to the valve core 295 for actuating the rotary switch between its two positions.

Referring back to FIG. 10, the change of fluid level of the wellbore fluids stored in either of the first or second pump chambers 75,80 provides the impetus for actuating the snap plate 310 and alternating between injecting the power gas into either the first pump chamber 75 (for conveying wellbore fluids therein to the production string) or the second pump chamber 80 (for conveying wellbore fluids therein to the production string).

The alternating or swing between the first and second pump chamber 75, 80 is fluid level dependent and thus correlates with the rate of inflow of wellbore fluids into the chamber 75 or 80 from the wellbore. In other words, a pumping rate of the pump 5 is self-regulated as the pumping rate increases with increasing flow of the wellbore fluids into the respective chamber and decreases with a decreasing flow of the wellbore fluids.

Returning to the float system 390, the proximal end 340 of the frame 330 comprises a U-shaped frame or yoke 345 having spaced apart rails 355,355 that straddle the pinion gear 367. One of the two spaced apart rails 355 supports the generally upstanding gear rack 360 having the gear teeth 365, while the other of the two spaced apart rails 355 support a generally upstanding confining rail 362, free of any gear teeth to avoid interference with the action of the gear rack 360.

Applicant notes that the confining rail 362 engages an opposing side of the pinion gear 367 and can also function to maintain engagement of the gear rack 360 with the pinion gear 367, regardless of the orientation of the pump. As the gear rack 360 moves up and down in engagement with the pinion gear 367, the pinion gear 367 is rotated. The confining rail 362 maintains engagement of the gear rack and pinion gear 367 with the proximal end 340 of the frame 330.

Although the embodiment shown in FIGS. 10 and 11A illustrate the float 329 supported on the frame 330 and U-shaped yoke 345 at the proximal end 340, a person of ordinary skill would understand that the float 329 can be supported on the distal end 350 of the frame 330 in several arrangements including a fixed support, and the proximal end yoke 345 can have any arrangement of driving connection between the proximal end 340 and the gear system 320.

As set forth above for the linear switch 190, the production string 10 and attached pump 5 can rotate, making it difficult to predict the landed orientation of the pump once the pump achieves its desired depth and position. Thus, the float float system 390 (shown in FIGS. 10 and 11A, and 11C) further accommodates self-orientation.

Simply, float frame 330 for the float and the gear system 320 adjust to pump orientation. An arrangement of weights and floats enable controlled rotation of the frame 330 about the mount 335 in response to pump orientation.

Having reference to FIG. 11B, one or both of the pair of rails 355,355 are fit with weights 370 and orientation floats 375. Further, the mount 335 is a universal joint type or ball type mount that is capable of freely rotating in all directions. Thus, as the pump 5 rotates, the orientation floats and weights urge the yoke 345 to self-orient and remain generally horizontal, causing the lever member 330 and attached float 329 to remain generally level as well.

Further, the gear rack 360 is substantially free of gear teeth at about a midpoint of the rack so as to enable self-orientation without conflict with the resulting relative rotation between the pinion gear 367 and the rack 360. Associated therewith, the confining rail 362 is toothless to enable locating of the yoke 345 and rack 360 about the pinion gear 367 while avoiding the conflict between rotation of the pinion gear 367 and vertical movement up and down of the yoke 345. The confining rail 362 also protects the proximal end 340 and gear rack 360 from shifting away from the pinion gear 367 during various pump rotations during pump landing (run into hole) operation.

Figure 11C:
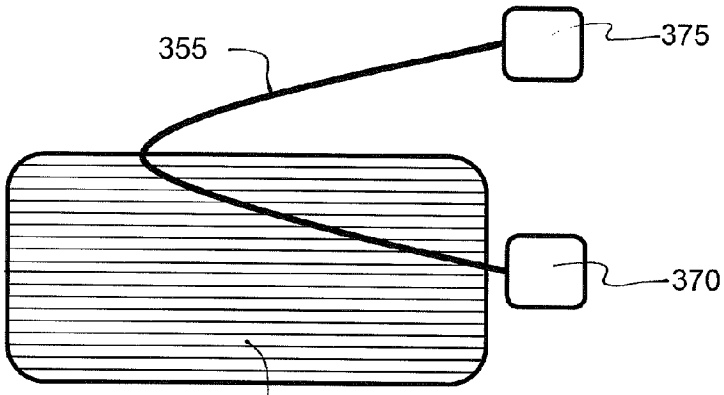
FIG. 11C is a side representative view of the embodiment of the proximal end of FIG. 11B, illustrating one of the two spaced apart rails being arcuate in shape, the rail reaching its highest point of travel on the pinion gear.
Figure 11D:
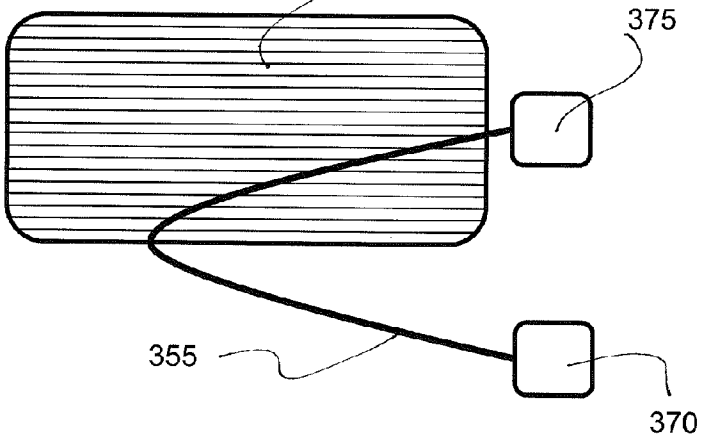
FIG. 11D is a side representative view of the rail of FIG. 11C, illustrating the rail reaching its lowest point of travel on the pinion gear.

FIGS. 11C and 11D illustrates an embodiment of the spaced apart rails 355,355 comprising arcuate rails for increasing an effective length of the spaced apart rails for increasing the number of gear teeth 365 on the gear rack 360 which can engage the pinion gear 367. The increased number of gear teeth allows greater control of the pinion gear 367 and thus the control of the gear system 320.

As shown in FIG. 11C, the spaced apart rail 355 is positioned higher relative to the pinion gear 367, which corresponds to when the fluid level in the chamber is low. That is, the float has fallen within the chamber as the fluid level therein is relatively low. However, as fluid level increases in the chamber, the float 329 rises, causing the proximal end 340 and the spaced apart rails 355 to lower, rotating the pinion gear 367 as the proximal end 350 travel downward (shown in FIG. 11D). Note that the overall vertical extent of the rails 355, with attached floats and weights 375,370, through the range of motion shown in FIGS. 11C,11D, is within the height of the hosting chamber.

Accordingly, through this arrangement, the float 329 is self-oriented and provides up and down actuating forces, during both raise and fall, through the float's buoyancy force acting through rack 360. The rack 360 transfers the vertical up and down movement to a rotational movement on pinion gear 367 therefore in the drive assembly 255.

The drive assembly 255 converts the continuous back and forth rotational oscillating motion of the pinion gear 367 into periodic and rapid actuation of the rotary valve 252.

As shown in FIG. 10 and in more detail in FIGS. 13-14F, the drive assembly 255 comprises the latency device, an assemblage of an indexing plate 317 connected for co-rotation with the pinion gear 367 about a gear axis $A_G$, and a snap assembly. The snap assembly converts the gear 367 and indexing plate 317 rotation of about 90 degrees into about a 45 degree rotation at the valve core 295. The snap assembly operates the valve core 295 of the rotary valve 252 rapidly between conveying power gas to the first or second chambers 75,80 for alternately conveying wellbore fluids from the first chamber 75 to the production string 10 or conveying the wellbore fluids from the second chamber 80 to the production string 10.

Figure 12B:
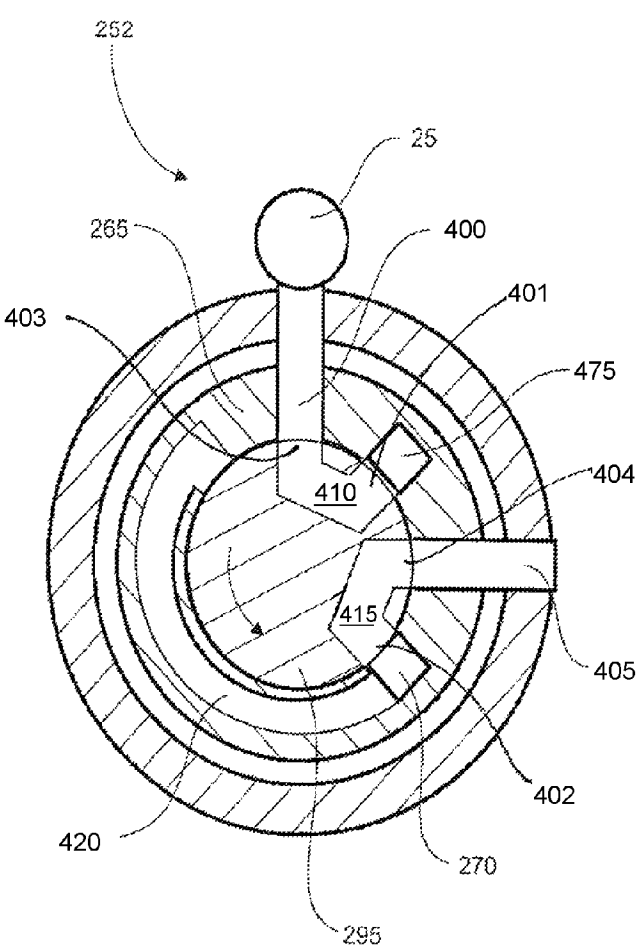
FIG. 12B is a partial axial cross-sectional view of the rotary valve of FIG. 12A in its second position, illustrating the power gas passage fluidly connecting the power gas line with the second chamber and the vent passage fluidly connecting the spent power gas return line with the first chamber.
Figure 12A:
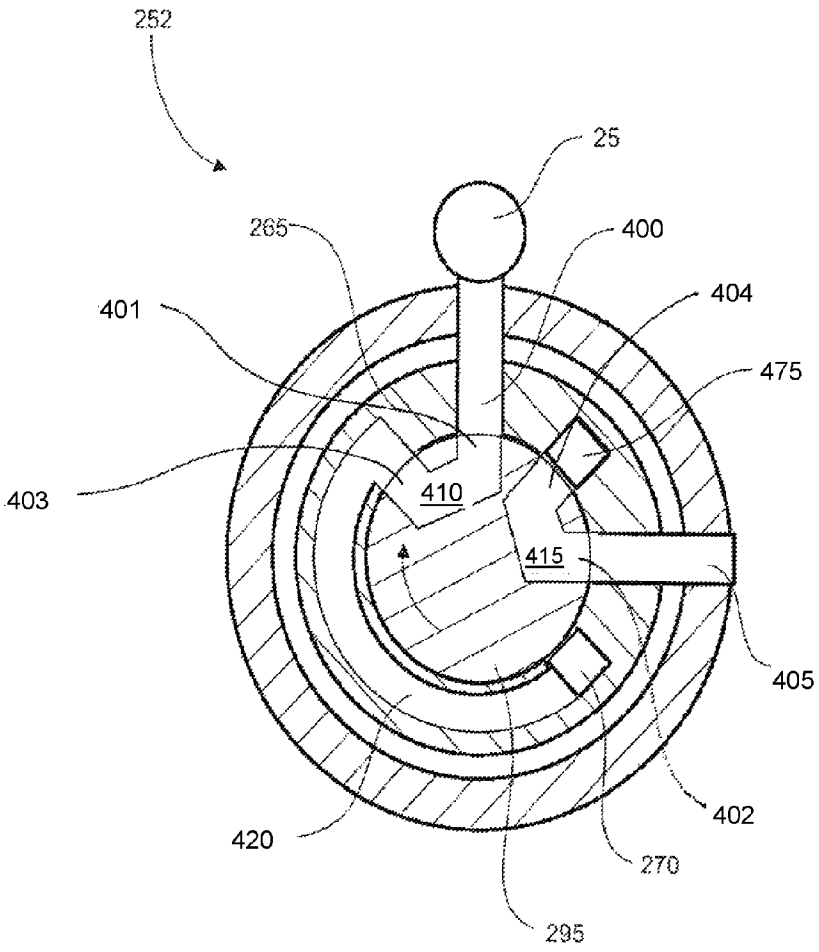
FIG. 12A is a partial axial cross-sectional view of the rotary valve of FIG. 10, illustrating a body with 4 ports and a power gas conduit, and a valve core in a first position, having a power gas passage fluidly connecting a first chamber to a power gas line and a vent passage fluidly connecting a second chamber to a spent power gas return line.

As shown in FIGS. 10, 12A and 12B the rotary valve 252 comprises the rotary body 265 having a first chamber port 270, a second chamber port 475, a power gas port 400, and a return gas port 405, arranged circumferentially within less than about one half of the valve body 265. As the valve core rotatably oscillates 45 degrees, the first chamber port 270 is alternately placed in fluid communication with either the power gas port 400 or the return gas port 405. The rotating valve core 295 has a pair of angularly spaced passages, a power gas passage 410 and a vent passage 415 that alternates between the first chamber port 400 and a second chamber port 405, and four ports 401,402,403,404 spaced circumferentially about the valve core 295. As shown in FIGS. 12A and 12B, the four ports 401,402,403,404, the power gas passage 410 and the vent passages 415 are arranged circumferentially within less than about one half of the valve core 295.

For first chamber actuation, a power gas conduit 420 extending about an opposing end of the valve body 295 and rotation of the valve core 295 alternately places the first chamber port 270 in fluid communication with the power gas passage 410 and the power gas port 400. Consequently, the second chamber port 475 is in fluid communication with the vent passage 415 and return gas port 405.

For second chamber actuation, rotation of the valve core 295 alternately places the second chamber port 475 in communication with the power gas passage 410 and power gas port 400. At the same time, the first chamber port 270 is in fluid communication with the return gas port 405 through the vent passage 415.

The return gas port 405 extends through the valve body 265 for fluid communication with the annulus 40. Port 405 in a rotary switch system is connected to port 115 as shown in FIG. 2. As referenced above, port 115 can be further extended through a separate pipe to a vertical section of annular space 40 where the pressure of the exhausting spent power gas is substantially lower than the wellbore pressure.

As shown, the rotary switch core 295 is rotatable between first and second core positions. In its first position, the first power gas passage 410 fluidly connects the power gas conduit 420 with the power gas port 400 and thus with the first chamber port 270 for permitting power gas G to enter into the first chamber 75, while simultaneously the second vent passage 415 fluidly connects the second chamber port 475 with the return gas port 405 for permitting power gas stored in the second chamber 80 to be expelled into the annulus 40. As a result, in its first core position, wellbore fluid previously received and stored in the first chamber 75 is conveyed to the production string 10, while simultaneously wellbore fluids from the wellbore 15 are received and stored in the second chamber 80 due to the lower pressure in that chamber caused by the release of gas through port 405.

In the second position of a switch cycle, the rotary core 295 is rotated in an opposite direction to its second core position for fluidly connecting the power gas line 25 with the second chamber port 475 through power gas passage 410, and simultaneously fluidly connecting the first chamber port 270 with the return gas port 405 via the second vent passage 415. Accordingly, in the rotary core's second position, the first chamber 75 is permitted to be filled with incoming wellbore fluids, while simultaneously the previously stored wellbore fluids in the second chamber 80 are conveyed to the production string 10.

Although not detailed, Applicant notes that delimiting shoulders, profile or stops could be inserted in the rotational interface between the rotary switch core 295 and switch body 265 for delimiting rotation, and preventing the core from over rotation to ensure precise alignment of the ports and conduits of the rotary valve 252. Further, a pressure equalization bleed passage can be provided through valve body 265 to deliver a small flow of power gas to the valve core opposing the power gas port 400 for balancing the force introduced at port 400. Pressure equalization counters this offsetting force and reduces the torque necessary to rotate the valve core 295.

Figures 13A, 13B:
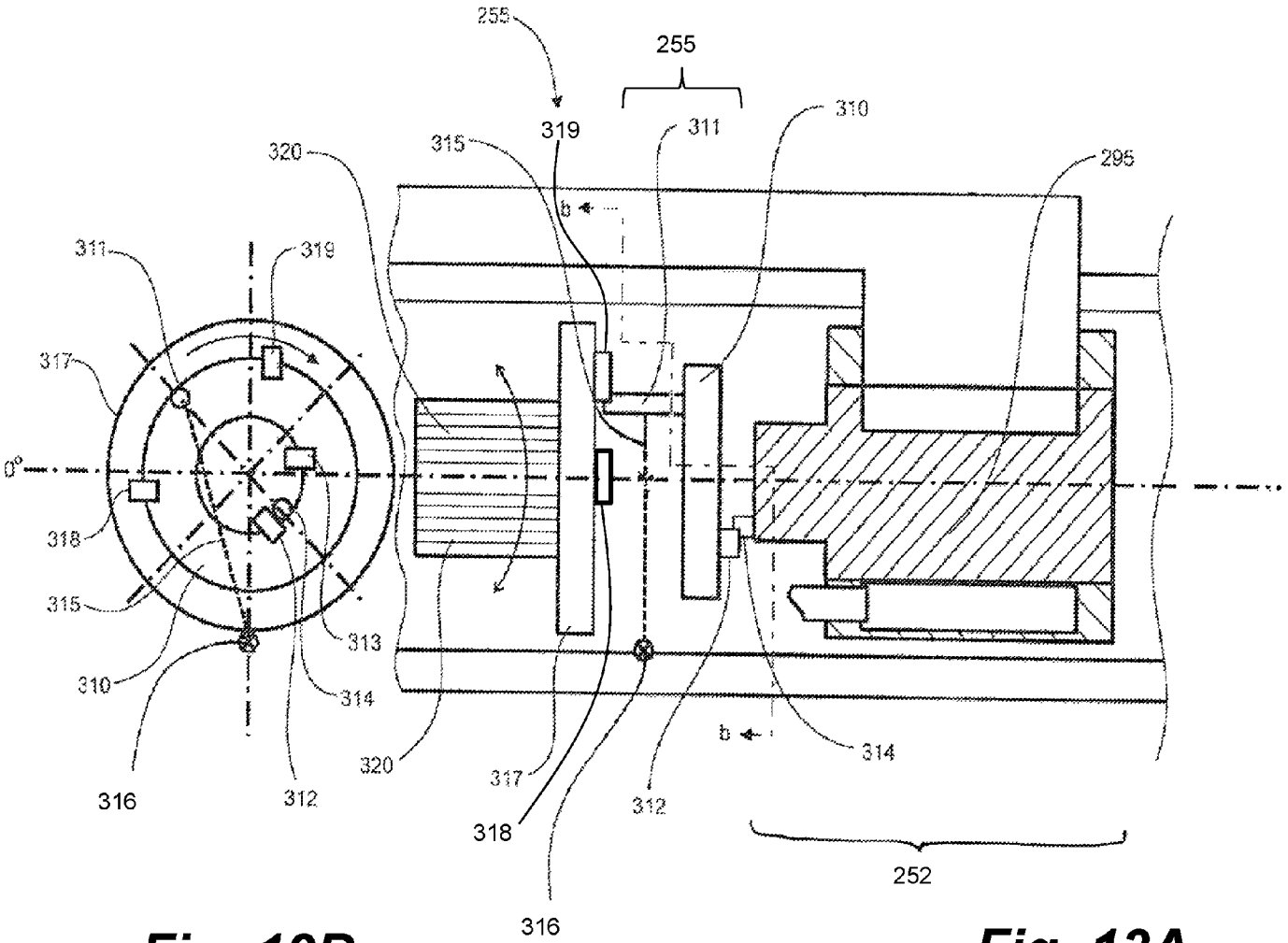
FIG. 13A is a partial side cross-sectional schematic drawing of the rotary switch of FIG. 10, illustrating the movement principle of a drive assembly having a snap plate, snap spring, and gears.
FIG. 13B is an axial end view of the rotary switch of FIG. 13A along line b-b for fancifully illustrating both the indexing plate and the snap plate stops.
Figure 13C:
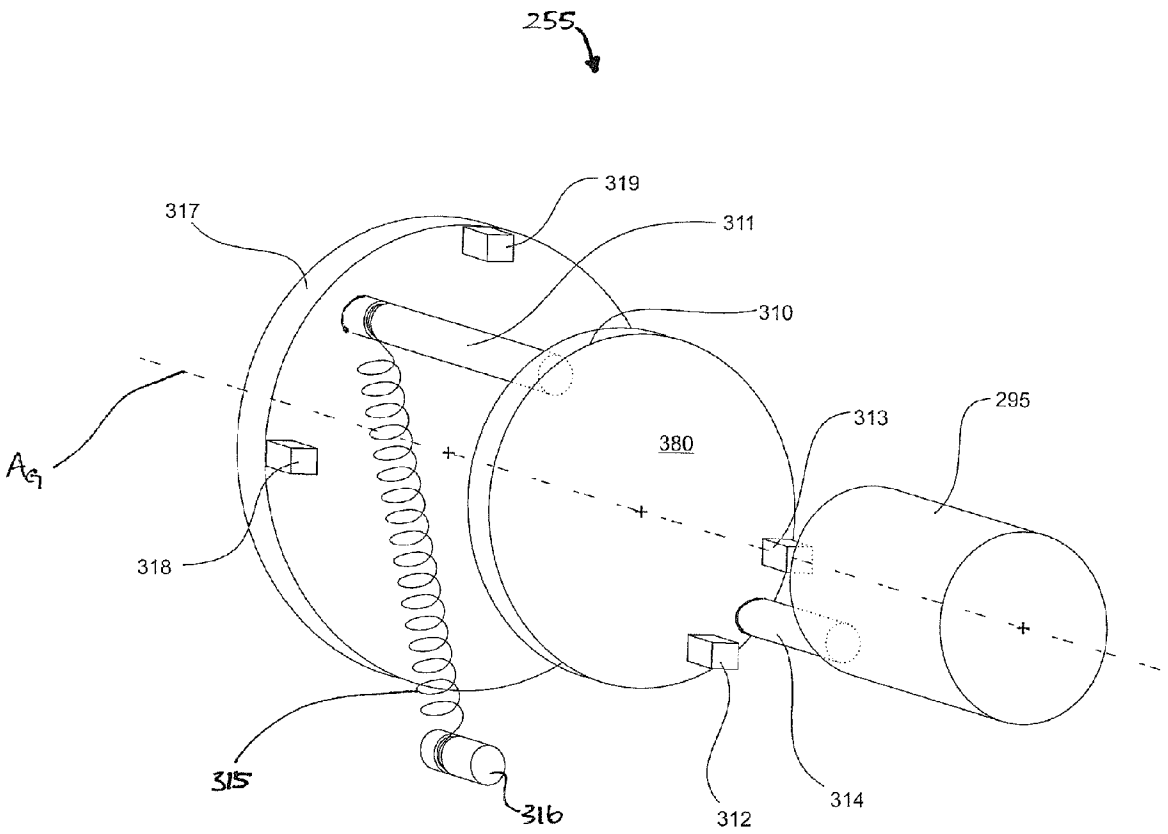
FIG. 13C is an exploded perspective view of the drive assembly of FIG. 13A illustrating indexing plate, snap plate, snap bar, snap spring and valve core.

With reference to FIGS. 13A, 13B, and 13C, and similar in principle to the rapid actuation of the linear switch embodiment above, the drive assembly 255 also comprises a latency device for suddenly alternating between conveying power gas to the first or second chambers 75,80.

As shown in FIG. 13A, the drive assembly 255 comprises the indexing plate 317 connected for co-rotation with the pinion gear 367 about the gear axis $A_G$, the indexing plate 317 having a pair of angularly spaced gear stops 318 and 319, in this case shown at about 90 degrees apart. The angular spacing of the stops 318,319 is determined by the extent of float movement and angular rotation of the gear system 320.

Further, the gear stops 318,319 cooperate with an eccentric snap bar 311 extending from about a periphery of a snap plate 310. The snap bar 311 forms a drive interface between the indexing plate 317 and the snap plate 310. The snap plate 310 is coaxial with the indexing plate 317 and axially spaced therefrom. As shown, the snap plate 310 is located between the indexing plate 317 and the rotary valve 252. The snap plate 310 is rotatable about the gear axis $A_G$ that is coaxial with that of the pinion gear 367, indexing plate 317 and rotary valve core 295. The rotational path of the snap bar 311 is rotationally delimited between the stops 318,319.

The valve core 295 is fit with an eccentric drive pin 314 extending towards the snap plate 310 and located at about a periphery of the rotary valve core 295. While the snap bar 311 extends towards the indexing plate 317, the snap plate 310 further comprises a valve face 380 on an opposing side facing the rotary valve 252. The valve face 380 is fit with a pair of angularly spaced core stops 312 and 313, also referred to as first and second drive stops 312 and 313, at about 45 degrees apart. The angular spacing of the core stops 312,313 is determined by the extent of rotational movement of the valve core 295. The rotational path of the gear stops 318,319 alternately engage the drive pin 314 to delimit rotation between the first and second core positions.

The indexing plate 317 and snap plate 310 are rotationally supported from the chamber or pump structure.

The snap plate 310 is rotatable between two alternating resting positions which correspond to either the first or second core positions. A biasing means, such as a snap device or spring 315 ensures that the snap plate 310 is biased in either of the two positions, and thus ensures that the valve core 295 is in either the first or second core operating position.

As shown in FIG. 13C, the snap spring 315 extends between about the snap bar 311 and a fixed snap point 316 located at a point diametrically opposing the snap bar 311 for angular oscillation or rotation back and forth across the gear axis $A_G$.

As shown, as the pinion gear 367 rotates in the first direction, the indexing plate 317 is rotated and the first gear stop 318 rotates to engage the snap bar 311. The gear stop 318 and snap bar 311 then rotate together and the snap spring 315 extends, loading the snap string to cause an increase in tension therein. At about a midpoint of travel, the snap spring 315 is under the most tension and the line of action of the spring 315 crosses or moves over the axis, over-centering and inherently causing the snap plate 310 to rotate rapidly. Consequently, core stop 313, moving in concert with the snap plate 310, engages the valve core's drive pin 314 and rotates the valve core 295 to the first core position. In the reverse cycle, the indexing plate 317 is rotated in second opposite direction and the second gear stop 319 rotates to engage the snap bar 311. The gear stop 319 and snap bar 311 rotate together in the opposite direction from the previous movement and the snap spring 315 extends once again. At about a midpoint of travel, the line of action of the snap spring 315 crosses over the axis, over-centering and inherently causing the snap plate 310 to rotate rapidly. Simultaneously, the core stop 312, moving in concert with the snap plate 310, engages the drive pin 314 and rotates the valve core 295 to the second core position.

Rotation of the pinion gear 367 causes the co-rotation of the snap bar 311 and snap plate 310, rotationally sweeping and extending the snap bar end of the snap spring 315 about the fixed snap point 316. As the sweep of the snap spring approaches a crossing of the gear axis, a core stop 312,313 engages the drive pin 314 so that when the snap spring 315 over-centers the gear axis $A_G$, a core stop 312,313 rapidly drives the drive pin 314 to actuate the valve core 295 to either its first or second position.

As shown in FIGS. 13B and 13C, the two gear stops 318,319 are mounted to indexing disk 317 at a designed angle, in this case about 90 degree from each other. The long snap bar 311 is eccentrically mounted on snap disk 310 with the snap spring 315 connected to it. The two additional short core stops 312,313 are mounted on the valve face 380 of the snap disk 310 at a designed angle, in this example about 45 degrees from each other. The short drive bar 314 is eccentrically mounted on switch core 295.

Functionally similar to the latency device of the linear switch, the angular spacing of the gear stops 318,319 is greater than the angular spacing of the core stops 312,313 for introducing a period of delay or dwell between the co-rotation of the indexing plate and when the snap spring 315 over-centers to the actuate the valve core 295. Further, a conversion of about a 90 degree gear rotation to about a 45 degree valve core rotation enables effective use of the limited valve core area for ports formed therein Based on the example and angular arrangement of gear stops 318,319 and drive stops 312,313 the indexing plate 317, energized by the float system, first rotates clockwise 45 degrees from its original baseline 0 degrees. At the 45 degrees angle, stop 318 engages and starts to direct the snap bar 311 for co-rotation until approaching the midpoint of the spring 315 which is oriented at 90 degrees in this embodiment. As gear stop 319 is mounted on indexing plate 317, when stop 318 reaches the midpoint, stop 319 will be at position of about 180 degrees. As described before, snap spring 315 at midpoint reaches its greatest tension and, when over-centered, will trigger a snap clockwise rotation of the snap plate 310. As shown in FIG. 10, it is noted that the system is designed in such way that rotating the pinion gear 367 and indexing plate 317 travels about 90 degrees when the float travels vertically for the available total distance between bottom and top of the respective chamber.

The short drive stops 312,313, being spaced 45 degrees from each other and mounted on the opposing side of the snap disk 310 from the long snap bar 311, dwell and keep steady with no rotation during the first 45 degrees rotation of indexing disk 317.

At about the point at which the snap spring 315 is at its midpoint the short drive stop 313 starts touching the short drive bar 314 and is ready to transfer the force from the spring 315 to the valve core 295. When the snap spring 315 over-centers and actuates the snap action, the stop 313 rotates the rotary valve core 295 for 45 degrees. The specific rotation of about 45 degrees of the rotary switch is chosen to coordinate with the passages formed therein and the angular space available to align the various passages and ports as described before in FIGS. 12A and 12B.

The complete cycle from the first to the second core position is set forth in FIGS. 14A to 14F.

FIGS. 14A to 14F illustrate an embodiment of the swing chamber pump having a rotary mechanism in operation illustrated in a step-by-step operation. Although not shown in FIGS. 14A to 14F, for the purposes of the description herein below, it will be assumed that the float system 390 is located in the first chamber 75. Further, for the purposes of the description, it will be assumed that the first chamber 75 is initially full of wellbore fluids and the second chamber 80 is empty.

Figure 14A:
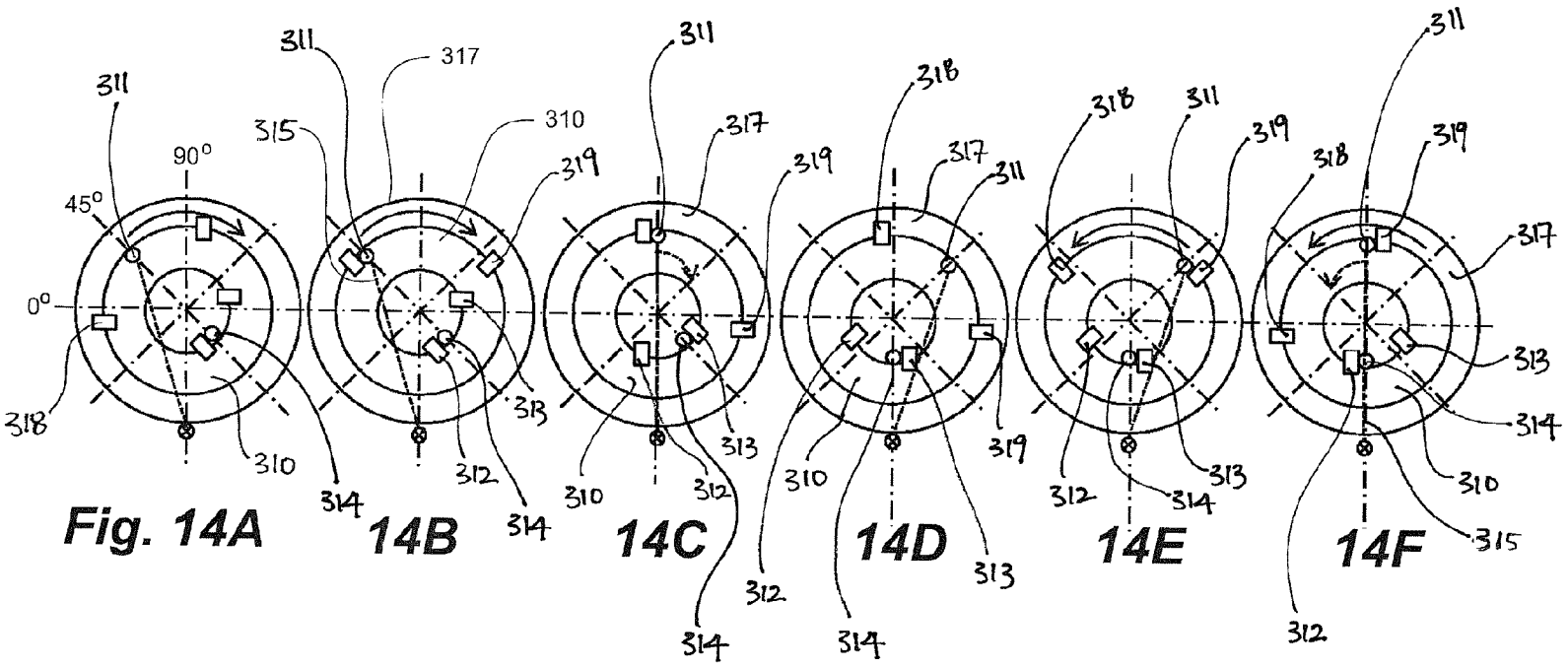
FIG. 14A is an axial schematic drawing of the drive assembly of FIG. 10 in its first position.

As shown in FIG. 14A when the first chamber 75 contains wellbore fluids therein, the float 329 is in a raised position while the proximal end 340 of the frame 330 is in a lowered position. Accordingly, the snap plate 310 is in its first position, and the first power gas passage 410 of FIG. 12A fluidly connects the power gas line 25 with the first chamber 75 and the second vent passage 415 fluidly connects the second chamber 80 with the return gas port 405. As a result, power gas G is directed into the first chamber 75 for conveying the wellbore fluids therein to the production string 10, while spent power gas in the second chamber 80 is allowed to be expelled into the wellbore annulus 40 as wellbore fluids flow into the second chamber 80.

As the power gas enters the first chamber 75, the power gas displaces the stored wellbore fluids into the production string 10. As the fluid level of the wellbore fluids in the first chamber 75 drops, the float 329 falls with the fluid level and causes the proximal end 340 of the frame 330 to correspondingly rise, rotating the gear system 320 and causing the gear stop 318 to engage the snap bar 311 of the snap plate 310 (shown in FIG. 14B).

With reference to FIG. 14C, at about a midpoint of the travel of the snap plate 310, the snap spring 315 has its greatest tension, and will inherently attempt to release the tension by reverting to either of its two resting positions. However, the combination of the gear system 320 and the float system 390 ensures that the snap plate 310 can travel only in a single direction, and as a result, the snap spring 315 causes the snap plate 310 to suddenly or snap into its second position (shown in FIG. 14D).

Referencing FIG. 14D and FIG. 12B, as previously described, with the snap plate 310 in its second position, the first power gas passage 410 fluidly connects the power gas line 25 with the second chamber port 475, while the second vent passage 415 fluidly connects the first chamber port 270 with the return gas port 290. This simultaneously permits power gas to enter into the second chamber 80 to convey the wellbore fluids therein to the production string 10 while simultaneously, the first chamber 75 expels the power gas therein to the return gas line 290, permitting wellbore fluids to enter into first chamber 75.

With reference to FIGS. 14E and 14F, as the first chamber 75 fills with wellbore fluids, the float 329 slowly rises and the proximal end 340 correspondingly lowers to cause the snap plate 310 to move in an opposite rotation, back into its first position.

This cycle of filling one chamber while emptying the second chamber is continued for providing a constant pumping of the wellbore fluids to the surface.

The above switches incorporate a latency device. Generally, and in an alternate embodiment, a mechanical latency device for a switch core can comprise an actuator having first and second drive stops; an intermediate driven member having a driven interface for alternate driving engagement with the first and second drive stops, the intermediate driven member having first and second switch stops; and a switch core having a switch interface for alternate driving engagement with the first and second switch stops. Actuation of the actuator from a first position to a second position engages the first stop with the driven interface of the intermediate driven member, loading an over-center snap device during a latency period until the first switch stop is aligned with the switch interface. This causes the snap device to over-center for unloading the snap device and driving the intermediate driven member, switch interface and switch core to the second position. Further actuation of the actuator from the second position to the first position engages the second stop with the driven interface of the intermediate driven member, loading the snap device during a latency period until the second switch stop is aligned with the switch interface. Similarly, this causes the snap device to over-center for unloading the snap device and driving the intermediate driven member, switch interface and switch core to the first position.

Thus in a linear embodiment, the actuator is a double-acting linear actuator, further comprising three rods aligned between the actuator 290 and the switch core 195, the actuator further comprising a connecting rod 212 extending from the actuator 290, the intermediate driven member 110 further comprising a proximal core rod 280 positioned axially between the connecting rod 212 and the switch core 195, and a distal core rod 210 positioned axially between the proximal core rod 280 and the valve core, the snap device 310 engaged with the proximal core rod for translation therewith. At least two baffles 225,230 are provided for enabling a dwell in the actuation, each of which have axially-spaced delimiting stops, comprising a proximal baffle 225 comprising the first and second drive stops 250F,250R, the proximal baffle connected to the connecting rod and between the proximal core rod and the connecting rod, and a distal baffle 230 comprising the first and second switch stops 230F,230R, the distal baffle connected to the proximal rod 280 between the proximal and distal rods 280,210.

When actuating the core rod between the first and second position, during the latency stage, the connecting rod and the first drive stop of the proximal baffle engage and translate the proximal rod for loading the snap bar, the axially-spaced first and second drive stops of the distal baffle moving freely about the distal core rod without actuating the valve core. When the snap bar reaches the actuation stage, a first switch stop of the distal baffle engages the distal core rod for snap actuation of the distal core rod and valve core to the second position, shifting the axially delimiting first and second drive stops of the proximal baffle to disengage from the connecting rod and engage the distal core rod.

When actuating the core rod between the second and first position, during the latency stage, the connecting rod and the second delimiting stop of the proximal baffle engage and translate the proximal rod for loading the snap bar, the axially-spaced first and second switch stops of the distal baffle moving freely about the distal core rod without moving the valve core, and when the snap bar reaches the actuation stage, a second switch stop of the distal baffle engages the distal core rod for snap actuation of the valve core to the first position, shifting the axially delimiting first and second drive stops of the proximal baffle to disengage from the proximal core rod and engage the connecting rod.

In another embodiment, when the actuator is an oscillating rotational actuator FIGS. 10-14F, the latency device comprises an indexing plate 317 connected for co-rotation with the actuator 390 about an actuator axis and a snap plate 310 coaxial with the indexing plate 317 and spaced axially therefrom. The indexing plate 317 has first and second angularly spaced drive stops 318,319 and the snap plate 310 having a drive interface 311, the drive interface 311 rotationally delimited by the first and second drive stops 318, 319. A snap device extends between about the drive interface and to a fixed snap point 316 about diametrically opposing the drive interface 311 for oscillating angular rotation back and forth across the actuator axis. The snap plate 310 has first and second angularly spaced switch stops 312,313; and the switch interface 314 is connected to the switch core 295 and radially spaced from the actuator axis.

At FIG. 14A, and upon rotation of the actuator 390 in a first direction, first drive stop 318 engages and co-rotates the drive assembly 255 at FIG. 14B, comprising at least the drive interface 311 and snap plate 310, rotationally sweeping and elastically loading the snap device. At FIG. 14C, as the sweep of the snap spring approaches over-centering the axis, the first switch stop 313 engages the switch core's switch interface 314 so that when the snap device over-centers the gear axis, the snap device unloads at FIG. 14D, and first switch stop 313 rapidly drives the switch interface 314 to actuate the switch core 295 to the first position. At FIG. 14E, upon rotation of the actuator 290 to oscillate the indexing plate back in a second direction, second drive stop 319 engages and co-rotates the snap device, rotationally sweeping and elastically loading the snap device, and as the sweep of the snap spring approaches the axis, the second switch stop 319 engages the switch interface 311 so that when the snap device over-centers the axis, the snap device unloads and the switch interface 311 actuates the switch core 295 to the second position.

In an embodiment, the angular spacing of the first and second drive stops 318,391 is greater than the angular spacing of the first and second switch stops 313,312 for introducing dwell between the co-rotation of the indexing plate and when the snap spring over-centers to actuate the switch core. Further, the angular spacing of the first and second drive stops is about 90 degrees, and the angular spacing of the first and second switch stops is about 45 degrees.

The invention claimed is:

1. A swing chamber pump for situating in a wellbore for lifting wellbore fluids through a production string to surface using a power gas directed from surface, the pump comprising:

a first and second pump chambers, each pump chamber having a fluid inlet for receiving the wellbore fluids therethrough from the wellbore, a self-orienting fluid outlet for maintaining fluid communication from a lower portion of the pump chamber to the production string, and a self-orienting gas valve comprising a gas conduit having a first gas interface urged to the upper headspace portion for maintaining fluid communication with an upper headspace portion of the pump chamber and a second gas interface alternately connected to the power gas for receiving power gas and directing the power gas into the upper headspace portion, and to the wellbore for expelling the power gas therefrom, and further comprising a self-orienting support comprising an orienting member rotatable about an intermediate pivot in response to orientation of the pump chamber, the orienting member having a first conduit end for positioning the first gas interface in the upper headspace portion, wherein when the power gas is directed into the upper headspace portion of the first pump chamber, the wellbore fluids are conveyed from the lower portion to the production string, and in the second pump chamber the power gas is expelled therefrom while wellbore fluids are received therein; and when the power gas is directed into the upper headspace portion of the second pump chamber, the wellbore fluids are conveyed from the lower portion and into the production string, and in the first pump chamber the power gas is expelled therefrom while wellbore fluids are received therein.

2. The pump of claim 1 wherein each self-orienting fluid outlet further comprises a fluid conduit having an outflow end fluidly connected to the production tubing and an inflow end urged by gravity to the lower portion, and a uni-directional check valve for one-way fluid communication from the lower portion.

3. The pump of claim 2, wherein the fluid conduit further comprises a flexible tubing.

4. The pump of claim 1, wherein the orienting member further comprises a float at the first conduit end and a weight at an opposing end.

5. The pump of claim 1, wherein the pump chambers are arranged coaxially in the wellbore:

the gas conduit extends generally axially from the first gas interface to the second gas interface; and the orienting member rotates in a plane transverse to the wellbore and the gas conduit is rotatably supported to the first conduit end for permitting free rotation thereof.

6. The pump of claim 1, wherein the gas conduit further comprises a flexible tubing.

7. The pump of claim 1, wherein the fluid inlet further comprises a flexible tubing for fluidly communicating wellbore fluids to the lower portion.

8. The pump of claim 1, further comprising a switch operable between a first position and a second position for alternately directing the power gas into either the first or second pump chamber.

9. The pump of claim 8, wherein the switch further comprises a valve comprising a valve body and a valve core, the valve core operable between the first position and the second position within the valve body for directing fluid through the valve wherein, when the switch is in its first position, the valve directs the power gas into one of either the first or second pump chamber, while simultaneously, spent power gas in the other of the second or first pump chamber is expelled therefrom, and when the switch is in its second position, the valve directs power gas into the other of the second or first pump chamber, while simultaneously, spent power gas in the other of the first or second pump chamber is expelled therefrom.

10. The pump of claim 9, further comprising:

an actuator operable between a first actuation position and a second actuation position; and a latency device between the actuator and the valve core wherein the latency device maintains the valve core in the first position until the actuator approaches the second actuation position and then reciprocates the valve core to the core's second position, and maintains the valve core in the second position until the actuator approaches the first actuation position and then reciprocates the valve core to the core's first position, thereby introducing a period of delay between reciprocation of the valve core between the first and second positions.

11. The pump of claim 10, wherein the latency device further comprises:

a snap bar intermediate the latency device and the actuator and connected between a first anchor point and a driven point movable with the actuator, the snap bar pivoting about the anchor point between a latency stage and an actuation stage; and a snap spring connected between a second anchor and the driven point movable with the actuator for applying compression into the snap bar during the latency stage and releasing the applied compression at the actuation stage, wherein the valve core remains in its first or second position until the snap bar reaches the actuation stage.

12. The pump of claim 10, wherein the actuator is a float and drive assembly for converting up and down float movement to a rotary oscillation of the valve core between the first and second positions; and the valve core is rotatable in the valve body between the first and second positions, the valve core having ports spaced circumferentially thereabout for alternating alignment with at least one power gas port and at least one return gas port in the valve body for alternating fluid communication with the first and second pump chambers, wherein when the switch is in its first position, a first port aligns with one of the at least one power gas port in the valve body to fluidly connect the power gas port with one of the first or second pump chambers while a second port aligns with one of the at least one return gas port in the valve body to fluidly connect the other of the second or first pump chambers to the wellbore, and wherein when the switch is in its second position, a third port aligns with one of the at least one power gas port in the valve body to fluidly connect the power gas with the other of the second or first pump chamber while a fourth port aligns with one of the at least one return port in the valve body to fluidly connect the other of the first or second pump chamber to the wellbore.

13. The pump of claim 12, wherein the valve core further comprises a power gas passage for fluidly connecting the first and third ports, and a vent passage for fluidly connecting the second and fourth ports, the third, first, fourth and second ports arranged circumferentially within less than about one half of the valve core; and the valve body further comprises one power gas port and one return gas port, a first chamber port and a second chamber port, the power gas port, first chamber port, return gas port and second chamber port arranged circumferentially within less than about one half of the valve body, and a power gas conduit extending about an opposing one half of the valve body for connecting the third port with the second chamber port when the switch is in the first position.

14. The pump of claim 12, wherein the float and drive assembly further comprises:

a float frame having a proximal end interfacing with the drive assembly and a distal end for supporting the float;

a mount intermediate the proximal and distal ends, the mount enabling rotation of the frame about a pump axis for self-orientation of the float for up and down float movement regardless of the pump orientation;

a gear system for translating up and down movement of the float into rotational movement, the gear system having a gear rack at the frame's proximal end and a pinion gear rotational about the pump axis and coupled by the latency device to the valve core.

15. The pump of claim 14, wherein the gear rack further comprises:

a U-shaped yoke having a pair of spaced apart rails straddling the pinion gear, one rail of the pair of spaced apart rails being generally upstanding and forming the gear rack for engaging the pinion gear, and the other rail of the pair of spaced apart rails having a generally upstanding confining rail for engaging an opposing side of the pinion gear for maintaining engagement of the gear rack with the pinion gear.

16. The pump of claim 15, wherein the gear rack is formed with a midpoint substantially free of gear teeth for enabling self-orientation.

17. The pump of claim 14, wherein the latency device further comprises:

an indexing plate connected for co-rotation with the pinion about a gear axis and a snap plate coaxial with the indexing plate and spaced axially therefrom, the indexing plate having first and second angularly spaced gear stops and the snap plate having a snap bar, the snap bar rotationally delimited by the first and second gear stops;

a snap spring extending between about the snap bar and to a fixed snap point about diametrically opposing the snap bar for oscillating angular rotation back and forth across the gear axis;

the snap plate having first and second angularly spaced core stops; and a drive pin connected to the valve core and radially spaced from the gear axis, wherein upon rotation of the pinion in a first direction, first gear stop engages and co-rotates the snap bar and snap plate, rotationally sweeping and extending the snap bar end of the snap spring about the fixed snap point, and as the sweep of the snap spring approaches crossing the axis, the first core stop engages the valve core's drive pin so that when the snap spring over-centers the gear axis, the first core stop rapidly drives the drive pin to actuate the valve core to the first position, and upon rotation of the pinion oscillates to rotate the indexing plate back in a second direction, second gear stop engages and co-rotates the snap bar and snap plate, rotationally sweeping and extending the snap bar end of the snap spring, and as the sweep of the snap spring approaches the axis, the second core stop engages the valve core's drive pin so that when the snap spring over-centers the axis, the drive pin actuates the valve core to the second position.

18. The pump of claim 17, wherein:

the angular spacing of the first and second gear stops is greater than the angular spacing of the first and second core stops for introducing a period of delay between the co-rotation of the indexing plate and when the snap spring over-centers to actuate the valve core.

19. The pump of claim 18, wherein:

the angular spacing of the first and second gear stops is about 90 degrees, and the angular spacing of the first and second core stops is about 45 degrees.

20. The pump of claim 9, wherein the valve core further comprises:

a linear core for reciprocating in a bore of the valve body between the first and second positions, the linear core having ports spaced axially for alternating alignment with a power gas line and a return gas vent port in the valve body for alternating fluid communication with the first and second pump chambers, wherein when the switch is in its first position, a first port aligns with the power gas port in the valve body to fluidly connect the power gas with one of the first or second pump chamber while a second port aligns with the return gas vent port in the valve body to fluidly connect the other of the second or first pump chamber to the wellbore, a third and fourth port being blocked by the valve body, and wherein when the switch is in its second position, a third port aligns with the power gas port in the valve body to fluidly connect the power gas with the other of the second or first pump chamber while a fourth port aligns with the return gas vent port in the valve body to fluidly connect the other of the first or second pump chamber to the wellbore, the first and second ports being blocked by the valve body.

21. The pump of claim 20, wherein the actuator is a double-acting linear actuator, the switch further comprising:

a source of pilot gas; and a pilot assembly having a diverter for alternately providing pilot gas to linear actuator for driving it between the first and second actuation positions.

22. The pump of claim 21, the pilot assembly further comprising:

a pilot rod connected between the valve core and the diverter for reciprocating diverter.

23. The pump of claim 22, wherein the latency device further comprises:

three rods between the actuator and the valve core, a connecting rod extending from the actuator, a proximal core rod positioned axially between the connecting rod and the valve core, and a distal core rod positioned axially between the proximal core rod and the valve core, the snap bar engaged with the proximal core rod and translates therewith;

at least two baffles, each of which having axially-spaced delimiting stops, comprising a proximal baffle connected to the connecting rod and between the proximal core rod and the connecting rod, and a distal baffle connected to the proximal core rod between the proximal and distal core rods; wherein when actuating the core rods between the first and second position, during the latency stage, the connecting rod and the delimiting stop of the proximal baffle engage and translate the proximal core rod for loading the snap bar, the axially-spaced delimiting stops of the distal baffle moving freely about the distal core rod without actuating the valve core, and when the snap bar reaches the actuation stage, a delimiting stop of the distal baffle engages the distal core rod for snap actuation of the distal core rod and valve core to the second position, shifting the axially delimiting stops of the proximal baffle to disengage from the connecting rod and engage the distal core rod, and when actuating the core rod between the second and first position, during the latency stage, the connecting rod and the delimiting stop of the proximal baffle engage and translate the proximal core rod for loading the snap bar, the axially-spaced delimiting stops of the distal baffle moving freely about the distal core rod without moving the valve core, and when the snap bar reaches the actuation stage, a delimiting stop of the distal baffle engaging the distal core rod for snap actuation of the valve core to the first position, shifting the axially delimiting stops of the proximal baffle to disengage from the proximal core rod and engage the connecting rod.

24. The pump of claim 23, further comprising a pivot pivotally connected between the pilot rod and the distal core rod.

25. The pump of claim 1, further comprising a switch operable between a first position and a second position for:

alternately directing the power gas to the self-orienting gas valve of either the first or second pump chamber, while alternately connecting the self-orienting gas valve to the other of the second or first pump chamber to the wellbore for expelling power gas.

26. A mechanical latency device for a switch core comprising:

an actuator having first and second drive stops;

an intermediate driven member having a driven interface for alternate driving engagement with the first and second drive stops, the intermediate driven member having first and second switch stops; and a switch core having a switch interface for alternate driving engagement with the first and second switch stops, wherein actuation of the actuator from a first position to a second position engages the first stop with the driven interface of the intermediate driven member, loading an over-center snap device during a latency period until the first switch stop is aligned with the switch interface;

over-centers the snap device for unloading the snap device and driving the intermediate driven member, switch interface and switch core to the second position, and actuation of the actuator from the second position to the first position engages the second stop with the driven interface of the intermediate driven member, loading the snap device during a latency period until the second switch stop is aligned with the switch interface;

over-centers the snap device for unloading the snap device and driving the intermediate driven member, switch interface and switch core to the first position.

27. The latency device of claim 26, wherein the actuator is a double-acting linear actuator, further comprising three rods aligned between the actuator and the switch core, the actuator further comprising a connecting rod extending from the actuator, the intermediate driven member further comprising a proximal core rod positioned axially between the connecting rod and the switch core, and a distal core rod positioned axially between the proximal core rod and the valve core, the snap device engaged with the proximal core rod for translation therewith;

at least two baffles, each of which having axially-spaced delimiting stops, comprising a proximal baffle comprising the first and second drive stops, the proximal baffle connected to the connecting rod and between the proximal core rod and the connecting rod, and a distal baffle comprising the first and second switch stops, the distal baffle connected to the proximal rod between the proximal and distal rods; wherein when actuating the core rod between the first and second position, during the latency stage, the connecting rod and the first drive stop of the proximal baffle engage and translate the proximal rod for loading the snap bar, the axially-spaced first and second drive stops of the distal baffle moving freely about the distal core rod without actuating the valve core, and when the snap bar reaches the actuation stage, a first switch stop of the distal baffle engages the distal core rod for snap actuation of the distal core rod and valve core to the second position, shifting the axially delimiting first and second drive stops of the proximal baffle to disengage from the connecting rod and engage the distal core rod, and when actuating the core rod between the second and first position, during the latency stage, the connecting rod and the second delimiting stop of the proximal baffle engage and translate the proximal rod for loading the snap bar, the axially-spaced first and second switch stops of the distal baffle moving freely about the distal core rod without moving the valve core, and when the snap bar reaches the actuation stage, a second switch stop of the distal baffle engages the distal core rod for snap actuation of the valve core to the first position, shifting the axially delimiting first and second drive stops of the proximal baffle to disengage from the proximal core rod and engage the connecting rod.

28. The latency device of claim 26, wherein the actuator is an oscillating rotational actuator, the latency device further comprising:

an indexing plate connected for co-rotation with the actuator about an actuator axis and a snap plate coaxial with the indexing plate and spaced axially therefrom, the indexing plate having first and second angularly spaced drive stops and the snap plate having a drive interface, the drive interface rotationally delimited by the first and second drive stops;

a snap device extending between about the drive interface and to a fixed snap point about diametrically opposing the drive interface for oscillating angular rotation back and forth across the actuator axis;

the snap plate having first and second angularly spaced switch stops; and the switch interface being connected to the switch core and radially spaced from the actuator axis, wherein upon rotation of the actuator in a first direction, first drive stop engages and co-rotates the drive interface and snap plate, rotationally sweeping and elastically loading the snap device, and as the sweep of the snap spring approaches over-centering the axis, the first switch stop engages the switch core's switch interface so that when the snap device over-centers the gear axis, the snap device unloads and first switch stop rapidly drives the switch interface to actuate the switch core to the first position, and upon rotation of the actuator to oscillate the indexing plate back in a second direction, second drive stop engages and co-rotates the snap device, rotationally sweeping and elastically loading the snap device, and as the sweep of the snap spring approaches the axis, the second switch stop engages the switch interface so that when the snap device over-centers the axis, the snap device unloads and the switch interface actuates the switch core to the second position.

29. The latency device of claim 28, wherein:

the angular spacing of the first and second drive stops is greater than the angular spacing of the first and second switch stops for introducing dwell between the co-rotation of the indexing plate and when the snap spring over-centers to actuate the switch core.

30. The latency device of claim 29, wherein:

the angular spacing of the first and second drive stops is about 90 degrees, and the angular spacing of the first and second switch stops is about 45 degrees.

31. A swing chamber pump for situating in a wellbore for lifting wellbore fluids through a production string to surface using a power gas directed from surface, the pump comprising:

a first and second pump chambers, each pump chamber having a fluid inlet for receiving the wellbore fluids therethrough from the wellbore, a self-orienting fluid outlet for maintaining fluid communication from a lower portion of the pump chamber to the production string, and a self-orienting gas valve for maintaining fluid communication with an upper headspace portion of the pump chamber and alternately directing the power gas into the upper headspace portion and expelling the power gas therefrom, wherein when the power gas is directed into the upper headspace portion of the first pump chamber, the wellbore fluids are conveyed from the lower portion to the production string, and in the second pump chamber the power gas is expelled therefrom while wellbore fluids are received therein; and when the power gas is directed into the upper headspace portion of the second pump chamber, the wellbore fluids are conveyed from the lower portion and into the production string, and in the first pump chamber the power gas is expelled therefrom while wellbore fluids are received therein; and a switch operable between a first position and a second position for alternately directing the power gas to the self-orienting gas valve of either the first or second pump chamber, while alternately connecting the self-orienting gas valve to the other of the second or first pump chamber to the wellbore for expelling power gas.

32. The pump of claim 31 wherein each self-orienting fluid outlet further comprises a fluid conduit having an outflow end fluidly connected to the production tubing and an inflow end urged by gravity to the lower portion, and a uni-directional check valve for one-way fluid communication from the lower portion.

33. The pump of claim 31, wherein the gas conduit further comprises a flexible tubing; and the fluid inlet further comprises a flexible tubing for fluidly communicating wellbore fluids to the lower portion.

34. The pump of claim 31, wherein the switch further comprises a valve comprising a valve body and a valve core, the valve core operable between the first position and the second position within the valve body for directing fluid through the valve when the switch is in its first position, the valve directs the power gas into one of either the first or second pump chamber, while simultaneously, spent power gas in the other of the second or first pump chamber is expelled therefrom, and when the switch is in its second position, the valve directs power gas into the other of the second or first pump chamber, while simultaneously, spent power gas in the other of the first or second pump chamber is expelled therefrom, the pump further comprising:

an actuator operable between a first actuation position and a second actuation position; and a latency device between the actuator and the valve core wherein the latency device maintains the valve core in the first position until the actuator approaches the second actuation position and then reciprocates the valve core to the core's second position, and maintains the valve core in the second position until the actuator approaches the first actuation position and then reciprocates the valve core to the core's first position, thereby introducing a period of delay between reciprocation of the valve core between the first and second positions.

35. The pump of claim 34, wherein the latency device further comprises:

a snap bar intermediate the latency device and the actuator and connected between a first anchor point and a driven point movable with the actuator, the snap bar pivoting about the anchor point between a latency stage and an actuation stage; and a snap spring connected between a second anchor and the driven point movable with the actuator for applying compression into the snap bar during the latency stage and releasing the applied compression at the actuation stage, wherein the valve core remains in its first or second position until the snap bar reaches the actuation stage.

36. The pump of claim 34 wherein the valve core further comprises:

a linear core for reciprocating in a bore of the valve body between the first and second positions, the linear core having ports spaced axially for alternating alignment with a power gas line and a return gas vent port in the valve body for alternating fluid communication with the first and second pump chambers, wherein when the switch is in its first position, a first port aligns with the power gas port in the valve body to fluidly connect the power gas with one of the first or second pump chamber while a second port aligns with the return gas vent port in the valve body to fluidly connect the other of the second or first pump chamber to the wellbore, a third and fourth port being blocked by the valve body, and wherein when the switch is in its second position, a third port aligns with the power gas port in the valve body to fluidly connect the power gas with the other of the second or first pump chamber while a fourth port aligns with the return gas vent port in the valve body to fluidly connect the other of the first or second pump chamber to the wellbore, the first and second ports being blocked by the valve body.

37. The pump of claim 34, wherein the actuator is a double-acting linear actuator, the switch further comprising:

a source of pilot gas; and a pilot assembly having a diverter for alternately providing pilot gas to linear actuator for driving it between the first and second actuation positions, the pilot assembly further comprising a pilot rod connected between the valve core and the diverter for reciprocating diverter, the latency device further comprises:

three rods between the actuator and the valve core, a connecting rod extending from the actuator, a proximal core rod positioned axially between the connecting rod and the valve core, and a distal core rod positioned axially between the proximal core rod and the valve core, the snap bar engaged with the proximal core rod and translates therewith;

at least two baffles, each of which having axially-spaced delimiting stops, comprising a proximal baffle connected to the connecting rod and between the proximal core rod and the connecting rod, and a distal baffle connected to the proximal core rod between the proximal and distal core rods; wherein when actuating the core rods between the first and second position, during the latency stage, the connecting rod and the delimiting stop of the proximal baffle engage and translate the proximal core rod for loading the snap bar, the axially-spaced delimiting stops of the distal baffle moving freely about the distal core rod without actuating the valve core, and when the snap bar reaches the actuation stage, a delimiting stop of the distal baffle engages the distal core rod for snap actuation of the distal core rod and valve core to the second position, shifting the axially delimiting stops of the proximal baffle to disengage from the connecting rod and engage the distal core rod, and when actuating the core rod between the second and first position, during the latency stage, the connecting rod and the delimiting stop of the proximal baffle engage and translate the proximal core rod for loading the snap bar, the axially-spaced delimiting stops of the distal baffle moving freely about the distal core rod without moving the valve core, and when the snap bar reaches the actuation stage, a delimiting stop of the distal baffle engaging the distal core rod for snap actuation of the valve core to the first position, shifting the axially delimiting stops of the proximal baffle to disengage from the proximal core rod and engage the connecting rod.

38. The pump of claim 34, wherein the actuator is a float and drive assembly for converting up and down float movement to a rotary oscillation of the valve core between the first and second positions; and the valve core is rotatable in the valve body between the first and second positions, the valve core having ports spaced circumferentially thereabout for alternating alignment with at least one power gas port and at least one return gas port in the valve body for alternating fluid communication with the first and second pump chambers, wherein when the switch is in its first position, a first port aligns with one of the at least one power gas port in the valve body to fluidly connect the power gas port with one of the first or second pump chambers while a second port aligns with one of the at least one return gas port in the valve body to fluidly connect the other of the second or first pump chambers to the wellbore, and wherein when the switch is in its second position, a third port aligns with one of the at least one power gas port in the valve body to fluidly connect the power gas with the other of the second or first pump chamber while a fourth port aligns with one of the at least one return port in the valve body to fluidly connect the other of the first or second pump chamber to the wellbore.

39. The pump of claim 38, wherein the float and drive assembly further comprises:

a float frame having a proximal end interfacing with the drive assembly and a distal end for supporting the float;

a mount intermediate the proximal and distal ends, the mount enabling rotation of the frame about a pump axis for self-orientation of the float for up and down float movement regardless of the pump orientation;

a gear system for translating up and down movement of the float into rotational movement, the gear system having a gear rack at the frame's proximal end and a pinion gear rotational about the pump axis and coupled by the latency device to the valve core.

40. The pump of claim 39, wherein the latency device further comprises:

an indexing plate connected for co-rotation with the pinion about a gear axis and a snap plate coaxial with the indexing plate and spaced axially therefrom, the indexing plate having first and second angularly spaced gear stops and the snap plate having a snap bar, the snap bar rotationally delimited by the first and second gear stops;

a snap spring extending between about the snap bar and to a fixed snap point about diametrically opposing the snap bar for oscillating angular rotation back and forth across the gear axis;

the snap plate having first and second angularly spaced core stops; and a drive pin connected to the valve core and radially spaced from the gear axis, wherein upon rotation of the pinion in a first direction, first gear stop engages and co-rotates the snap bar and snap plate, rotationally sweeping and extending the snap bar end of the snap spring about the fixed snap point, and as the sweep of the snap spring approaches crossing the axis, the first core stop engages the valve core's drive pin so that when the snap spring over-centers the gear axis, the first core stop rapidly drives the drive pin to actuate the valve core to the first position, and upon rotation of the pinion oscillates to rotate the indexing plate back in a second direction, second gear stop engages and co-rotates the snap bar and snap plate, rotationally sweeping and extending the snap bar end of the snap spring, and as the sweep of the snap spring approaches the axis, the second core stop engages the valve core's drive pin so that when the snap spring over-centers the axis, the drive pin actuates the valve core to the second position.

* * * * *